US009126797B2

(12) United States Patent
Kikuchi et al.

(10) Patent No.: US 9,126,797 B2
(45) Date of Patent: Sep. 8, 2015

(54) SHEET PROCESSING APPARATUS AND IMAGE FORMING SYSTEM

(71) Applicants: Atsushi Kikuchi, Kanagawa (JP); Takuya Sano, Kanagawa (JP); Takao Watanabe, Kanagawa (JP); Makoto Hidaka, Tokyo (JP); Satoshi Saito, Kanagawa (JP); Shohichi Satoh, Kanagawa (JP); Tomomichi Hoshino, Kanagawa (JP); Kiyoshi Hata, Tokyo (JP); Keisuke Sugiyama, Tokyo (JP)

(72) Inventors: Atsushi Kikuchi, Kanagawa (JP); Takuya Sano, Kanagawa (JP); Takao Watanabe, Kanagawa (JP); Makoto Hidaka, Tokyo (JP); Satoshi Saito, Kanagawa (JP); Shohichi Satoh, Kanagawa (JP); Tomomichi Hoshino, Kanagawa (JP); Kiyoshi Hata, Tokyo (JP); Keisuke Sugiyama, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/154,227

(22) Filed: Jan. 14, 2014

(65) Prior Publication Data

US 2014/0206517 A1 Jul. 24, 2014

(51) Int. Cl.

| | |
|---|---|
| ***B65H 45/12*** | (2006.01) |
| ***B31F 1/00*** | (2006.01) |
| ***B65H 37/04*** | (2006.01) |
| ***B65H 45/18*** | (2006.01) |
| *B65H 45/04* | (2006.01) |

(52) U.S. Cl.

CPC *B65H 45/12* (2013.01); *B31F 1/00* (2013.01); *B65H 37/04* (2013.01); *B65H 45/18* (2013.01); *B65H 45/04* (2013.01); *B65H 2301/51232* (2013.01); *B65H 2701/13212* (2013.01); *B65H 2801/27* (2013.01)

(58) Field of Classification Search

CPC ..... B31F 1/00; B31F 1/0006; B31F 1/0035; B65H 45/12; B65H 45/04; B65H 2801/27

USPC ..... 270/32, 45, 58.07

See application file for complete search history.

(56) References Cited

U.S. PATENT DOCUMENTS

| | | | | |
|---|---|---|---|---|
| 6,817,605 | B1 * | 11/2004 | Bohn | 270/37 |
| 7,673,862 | B2 * | 3/2010 | Kushida et al. | 270/32 |
| 7,905,473 | B2 * | 3/2011 | Tamura et al. | 270/32 |
| 7,922,162 | B2 * | 4/2011 | Kamiya | 270/45 |
| 8,083,218 | B2 * | 12/2011 | Dobashi et al. | 270/45 |
| 8,226,078 | B2 * | 7/2012 | Watanabe et al. | 270/45 |
| 2003/0151187 | A1 | 8/2003 | Suzuki et al. | |
| 2003/0160376 | A1 | 8/2003 | Yamada et al. | |
| 2003/0215275 | A1 | 11/2003 | Tamura et al. | |
| 2003/0219295 | A1 | 11/2003 | Saitoh et al. | |
| 2003/0234487 | A1 | 12/2003 | Tamura et al. | |
| 2004/0070133 | A1 | 4/2004 | Yamada et al. | |
| 2004/0104525 | A1 | 6/2004 | Suzuki et al. | |
| 2009/0200725 | A1 | 8/2009 | Tamura et al. | |

FOREIGN PATENT DOCUMENTS

| | | |
|---|---|---|
| JP | 2009-190824 | 8/2009 |

* cited by examiner

*Primary Examiner* — Leslie A Nicholson, III

(74) *Attorney, Agent, or Firm* — Harness, Dickey & Pierce, P.L.C.

(57) ABSTRACT

The present invention is concerning to a sheet processing apparatus comprising: a pressing unit configured to provide additional folding to a fold line portion of a sheet bundle by pressing the fold line portion; a carriage unit configured to reciprocate the pressing unit in width directions of the sheet bundle; a guiding shaft configured to support the pressing unit and guides movement of the pressing unit; and a supporting unit configured to support the pressing unit and moves on a structure provided to the sheet processing apparatus.

16 Claims, 20 Drawing Sheets

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2013-007729 filed in Japan on Jan. 18, 2013.

BACKGROUND OF THE INVENTION

1. Field of the Invention

The present invention relates to a sheet processing apparatus and an image forming system, and more particularly to a sheet processing apparatus provided with a function for folding a sheet-like recording medium such as a paper sheet, a recording paper sheet, and a transfer paper sheet (hereinafter, simply referred to as a "sheet"), and an image forming system provided with the sheet processing apparatus.

2. Description of the Related Art

Some post-processing apparatuses used in combination with an image forming apparatus such as a copier have conventionally been capable of binding one or more sheets into a saddle stitched brochure by binding the sheets at the center and folding the sheet bundle at the center with a folding roller pair provided in parallel with a direction in which the sheets are folded. Also known to enhance the fold line portion on a saddle stitched brochure is a technology that performs additional folding to the brochure using a roller carried along the spine of the brochure.

In such a technology providing additional folding, to provide additional folding along the spine (fold line portion) of a brochure (sheet bundle) using an additional folding roller, the roller is kept standby outside of the brochure, placed on top of the spine of the brochure, and then carried along the spine.

As an example of the additional folding technology, the invention disclosed in Japanese Laid-open Patent Publication No. 2009-190824 is known. This invention discloses a sheet folding apparatus that is provided with an additional folding unit including a pressing roller that rolls along the fold line portion of a sheet bundle that is folded by a folding unit, an elastic biasing unit that elastically applies a biasing force to the pressing roller in the thickness direction of the sheet bundle, and a driving unit that carries the pressing roller in a direction perpendicular to the conveying direction of the sheet bundle. The sheet folding apparatus provides additional folding by causing the additional folding unit to press the fold line portion of the sheet bundle having already folded by the folding unit. The sheet folding apparatus is characterized in including a lifting unit that brings up the pressing roller before the pressing roller reaches an end surface of the sheet bundle so that the pressing roller is not allowed to roll over the end surface, and then lowers the pressing roller from a predetermined position, whereby bringing the pressing roller into contact with the top surface of the fold line portion.

In the invention disclosed in Japanese Laid-open Patent Publication No. 2009-190824, guiding members are used to bring up the pressing roller before the pressing roller reaches the end surface of the sheet bundle, and the pressing roller is caused to press the sheet bundle from the top of the fold line portion of the sheet bundle again. Two slide shafts are used in moving the roller.

In this manner, in the invention disclosed in Japanese Laid-open Patent Publication No. 2009-190824, guiding shafts serving as guiding members are used in moving the pressing roller rolling along the spine (fold line portion) of the sheet bundle. In such a structure, if a high load is applied to the pressing roller to enhance the fold on the sheet bundle, the slide shafts might become bent. If the slide shafts become bent, the pressure becomes insufficient at the center of the slide shafts. Therefore, it has been difficult to stabilize the pressure applied to the sheet bundle.

In view of the above-mentioned problems on the conventional art, there is need to stabilize the pressure applied to a saddle-stitched sheet bundle when additional folding is applied along the spine of the sheet bundle.

SUMMARY OF THE INVENTION

It is an object of the present invention to at least partially solve the problems in the conventional technology.

According to the present invention, there is provided a sheet processing apparatus comprising: a pressing unit configured to provide additional folding to a fold line portion of a sheet bundle by pressing the fold line portion; a carriage unit configured to reciprocate the pressing unit in width directions of the sheet bundle; a guiding shaft configured to support the pressing unit and guides movement of the pressing unit; and a supporting unit configured to support the pressing unit and moves on a structure provided to the sheet processing apparatus.

The present invention also provides an image forming system including a sheet processing apparatus, wherein the sheet processing apparatus comprises: a pressing unit configured to provide additional folding to a fold line portion of a sheet bundle by pressing the fold line portion; a carriage unit configured to reciprocate the pressing unit in width directions of the sheet bundle; a guiding shaft configured to support the pressing unit and guides movement of the pressing unit; and a supporting unit configured to support the pressing unit and moves on a structure provided to the sheet processing apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The present invention is characterized in that, when rollers for providing additional folding to the spine of a saddle-stitched sheet bundle are carried, the rollers are guided and supported not only by guiding shafts but also by a housing.

An embodiment of the present invention will now be explained with reference to some drawings.

Figure 1:
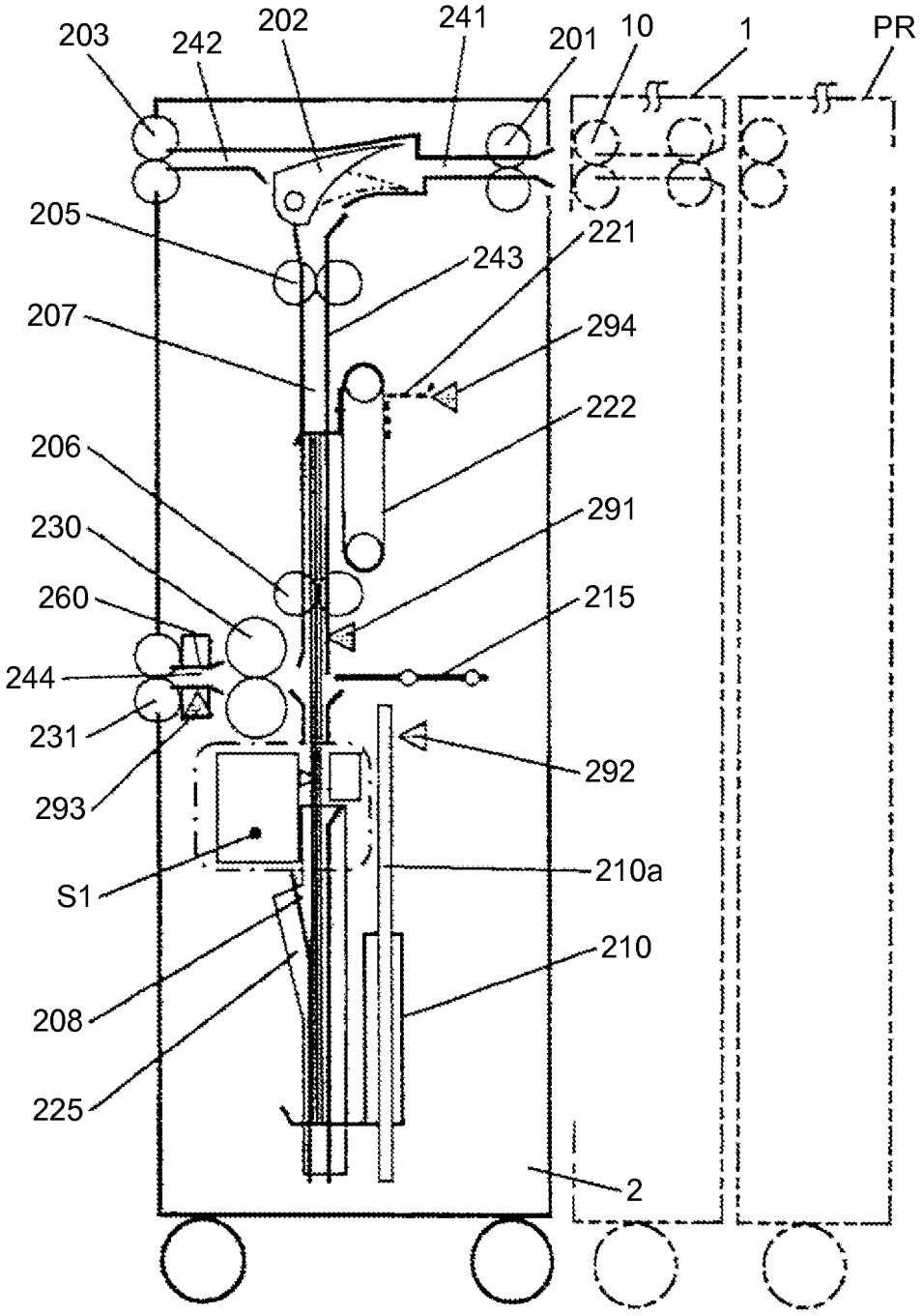
FIG. 1 is a diagram illustrating a system structure of an image processing system including an image forming apparatus and a plurality of sheet processing apparatuses according to an embodiment of the present invention.

FIG. 1 is a diagram illustrating a system structure of an image processing system including an image forming apparatus and a plurality of sheet processing apparatuses according to the embodiment. In the embodiment, two sheet post-processing apparatus are used as a plurality of sheet processing apparatus, and a first sheet post-processing apparatus 1 and a second sheet post-processing apparatus 2 are connected to each other, in the order described herein, subsequently to an image forming apparatus PR.

The first sheet post-processing apparatus 1 is a sheet post-processing apparatus having a function of receiving one sheet at a time from the image forming apparatus PR, stacking and aligning the sheets sequentially to form a sheet bundle in a stacker. Sheet bundle discharging rollers 10 in the first sheet post-processing apparatus 1 discharge the sheet bundle into the second sheet post-processing apparatus 2 subsequently positioned. The second sheet post-processing apparatus 2 is a saddle-stitch book binding apparatus (the second sheet post-processing apparatus is hereinafer also referred to as a saddle-stitch book binding apparatus) that receives the sheet bundle fed from the first sheet post-processing apparatus 1, and saddle-stitches and folds the sheet bundle at the center.

The saddle-stitch book binding apparatus 2 discharges the brochure (sheet bundle) thus bounded as it is, or discharges the brochure into a sheet processing apparatus subsequently provided. The image forming apparatus PR forms a visible image on a sheet-like recording medium based on input image data, or based on image data representing a scanned image. The image forming apparatus PR corresponds to a copier, a printer, a facsimile, or a digital multifunction peripheral including at least two of these functions of these machines, for example. The image forming apparatus PR may employ any known image forming method such as an electrophotographic system or a liquid droplet ejection system.

In FIG. 1, the saddle-stitch book binding apparatus 2 includes an entrance conveyance path 241, a sheet-through conveyance path 242, and a center-folding conveyance path 243. Entrance rollers 201 are provided on the uppermost stream part of the entrance conveyance path 241 in a sheet conveying direction, and through the entrance roller the aligned sheet bundle is conveyed into the apparatus from the sheet bundle discharging rollers 10 of the first sheet post-processing apparatus 1. In the explanation hereunder, the upstream side of the sheet conveying direction is simply referred to as an upstream side, and the downstream side in the sheet conveying direction is simply referred to as a downstream side.

A bifurcating claw 202 is provided in the entrance conveyance path 241, on the downstream side of the entrance rollers 201. The bifurcating claw 202 is arranged in the horizontal direction in FIG. 1, and bifurcates the conveyance direction of the sheet bundle into the sheet-through conveyance path 242 or the center-folding conveyance path 243. The sheet-through conveyance path 242 is a conveyance path extending horizontally from the entrance conveyance path 241, and guiding the sheet bundle to a processing apparatus not illustrated subsequently positioned or into a discharge tray. Upper discharging rollers 203 discharge the sheet bundle to the subsequent stage. The center-folding conveyance path 243 is a conveyance path extending vertically from the bifurcating claw 202 in a downward direction, and is a conveyance path for providing saddle stitching and center folding to the sheet bundle.

The center-folding conveyance path 243 includes an upper bundle conveyance guide board 207 for guiding the sheet bundle in a section above a folding plate 215 providing center folding, and a lower bundle conveyance guide board 208 for guiding the sheet bundle in a section below the folding plate

215. The upper bundle conveyance guide board 207 is provided with upper bundle conveyance rollers 205, a rear end hitting claw 221, and lower bundle conveyance rollers 206, sequentially from the top. The rear end hitting claw 221 is provided upright on a rear end hitting claw driving belt 222 that is driven by a driving motor not illustrated. The rear end hitting claw 221 is caused to hit (to push) the rear end of the sheet bundle against a movable fence, which is to be described later, by the back-and-forth rotating movement of the rear end hitting claw driving belt 222, and aligns the sheet bundle. The rear end hitting claw 221 escapes from the center-folding conveyance path 243 in the upper bundle conveyance guide board 207 (the position indicated by a dotted line in FIG. 1) when the sheet bundle is fed and when the sheet bundle is elevated to be provided with center-folding.

The reference numeral 294 represents a rear end hitting claw HP sensor for detecting the home position of the rear end hitting claw 221. The rear end hitting claw HP sensor detects the position indicated by the dotted line in FIG. 1 (the position indicated by a solid line in FIG. 2) to which the rear end hitting claw 221 escapes from the center-folding conveyance path 243 as the home position. The rear end hitting claw 221 is controlled with reference to the home position.

The lower bundle conveyance guide board 208 includes a saddle stitching stapler S1, a saddle stitching jogger fence 225, and a movable fence 210, sequentially from the top in the order described herein. The lower bundle conveyance guide board 208 is a guiding board for receiving the sheet bundle conveyed through the upper bundle conveyance guide board 207. The saddle stitching jogger fence 225 is provided in a pair in the width direction of the lower bundle conveyance guide board 208. The leading edge of the sheet bundle abuts against (is supported by) the bottom of the lower bundle conveyance guide board 208. The movable fence 210 is provided movably in the vertical direction.

The saddle stitching stapler S1 is a stapler for binding the sheet bundle at the center. The movable fence 210 moves up and down while supporting the leading edge of the sheet bundle so as to bring the central position of the sheet bundle to a position facing the saddle stitching stapler S1. At this position, the sheet bundle is stapled, that is, saddle-stitched. The movable fence 210 is supported by a movable fence driving mechanism 210*a*, and is movable from a position of a movable fence HP sensor 292 positioned at an upper side in FIG. 1 to the lowest position. The movable range of the movable fence 210 against which the leading edge of the sheet bundle abuts is ensured to have a stroke for allowing the maximum size to the minimum size of a sheet that can be handled by the saddle-stitch book binding apparatus 2 to be processed. As the movable fence driving mechanism 210*a*, a rack-and-pinion mechanism is used, for example.

Provided between the upper bundle conveyance guide board 207 and the lower bundle conveyance guide board 208, that is, at a position almost at the center of the center-folding conveyance path 243 are the folding plate 215, a folding roller pair 230, an additional folding roller unit 260, and lower discharging rollers 231. The additional folding roller unit 260 includes additional folding rollers respectively positioned above and below a discharging conveyance path provided between the folding roller pair 230 and the lower discharging rollers 231. The folding plate 215 can be reciprocated in the horizontal directions in FIG. 1. The nip between the folding roller pair 230 is positioned in a direction toward which the folding plate 215 moves to perform a folding operation, and the discharging conveyance path 244 is provided along the extension of such a direction. The lower discharging rollers 231 are provided to the most downstream side of the discharging conveyance path 244, and discharge the folded sheet bundle to the subsequent stage.

A sheet bundle detecting sensor 291 is provided near the lower end of the upper bundle conveyance guide board 207, and detects the leading edge of the sheet bundle conveyed into the center-folding conveyance path 243 and passing through the center-folding position. A fold line portion passage sensor 293 is provided on the discharging conveyance path 244, and detects the leading edge of the sheet bundle folded at the center so that the passage of the sheet bundle is recognized.

The saddle-stitch book binding apparatus 2 having a general structure illustrated in FIG. 1 performs a saddle stitching and center folding operation as illustrated in schematics for explaining operations provided in FIGS. 2 to 6. To explain specifically, when a user selects saddle stitching/center folding in an operation panel not illustrated provided to the image forming apparatus PR, the bifurcating claw 202 is displaced in the counterclockwise direction, and the sheet bundle for which the saddle stitching/center folding is selected is guided toward the center-folding conveyance path 243. The bifurcating claw 202 is driven by a solenoid. The bifurcating claw 202 may also be driven by a motor instead of a solenoid.

Figure 2:
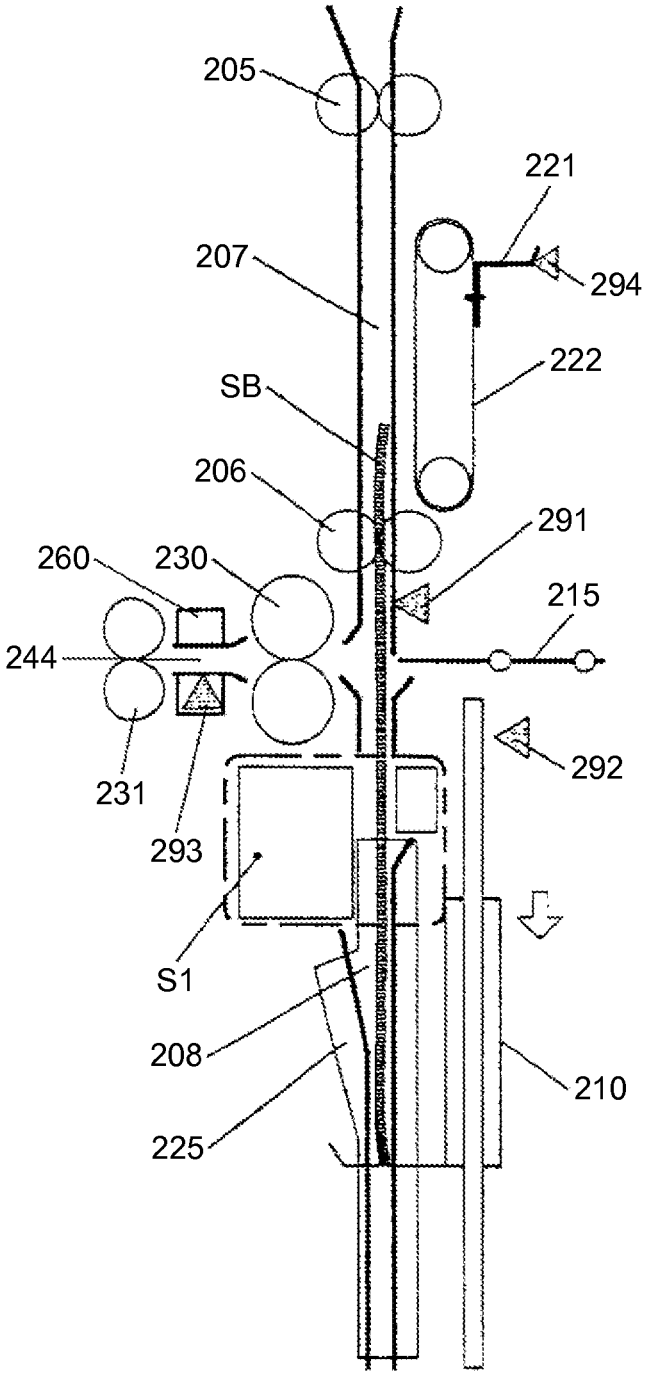
FIG. 2 is a diagram explaining an operation performed by the saddle-stitch book binding apparatus when a sheet bundle is conveyed into a center-folding conveyance path.

The sheet bundle SB conveyed into the center-folding conveyance path 243 is further conveyed downwardly in the center-folding conveyance path 243 by the entrance rollers 201 and the upper bundle conveyance rollers 205. After the sheet bundle detecting sensor 291 recognizes the passage of the sheet bundle SB, the sheet bundle SB is conveyed by the lower bundle conveyance rollers 206 to a position at which the leading edge of the sheet bundle SB abuts against the movable fence 210, as illustrated in FIG. 2. At this time, the movable fence 210 is kept standby at a standby position determined based on sheet size information received from the image forming apparatus PR, e.g., in this example, information of the size of each sheet bundle SB in the conveying direction. At this time, in FIG. 2, the sheet bundle SB is held in the nip between the lower bundle conveyance rollers 206, and the rear end hitting claw 221 is kept standby at the home position.

Figure 3:
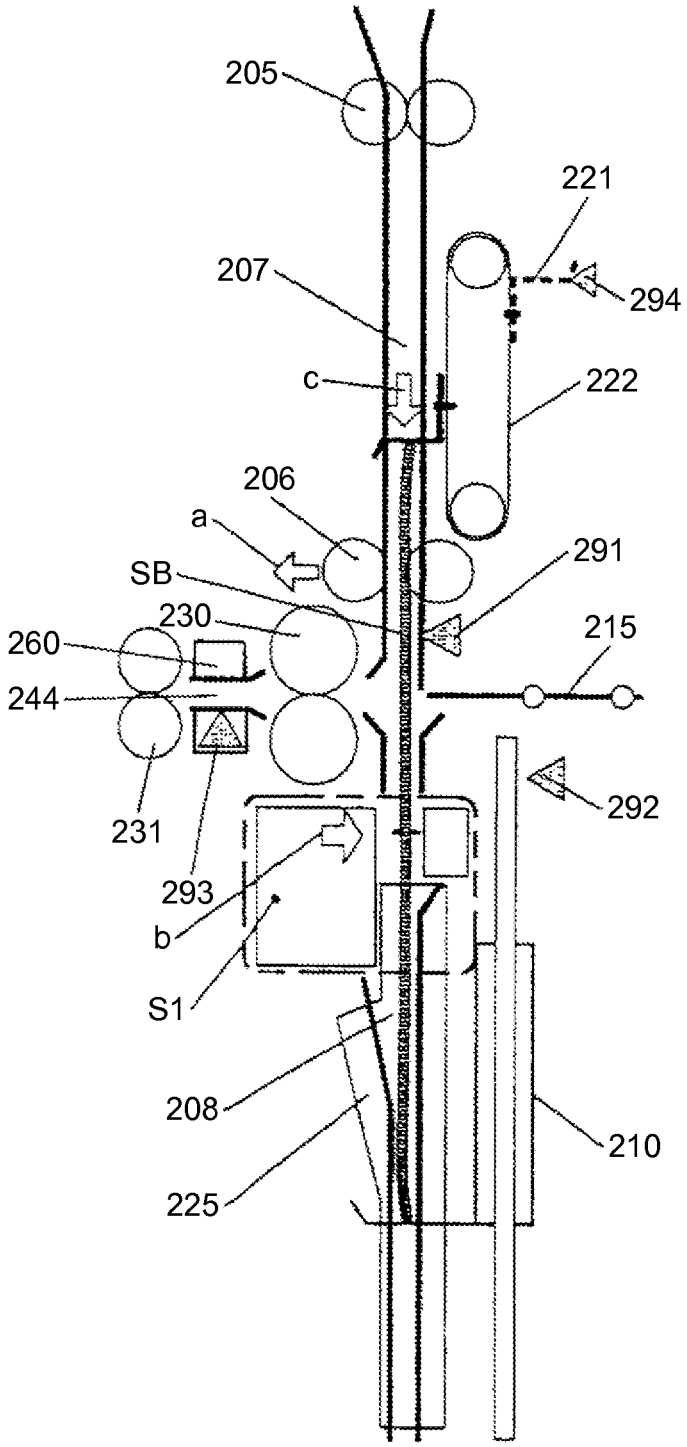
FIG. 3 is a diagram explaining an operation performed by the saddle-stitch book binding apparatus when the sheet bundle is to be saddle stitched.

When the nipping force of the lower bundle conveyance rollers 206 is released, as illustrated in FIG. 3 (in the direction of the arrowed line a), whereby causing leading edge of the sheet bundle to fall and to abut against the movable fence 210 so that the rear end of the sheet bundle is no longer held, the rear end hitting claw 221 is driven and caused to hit the rear end of the sheet bundle SB to perform the final alignment of the sheet bundle in the conveying direction (in the direction of the arrowed line c).

The saddle stitching jogger fences 225 align the sheet bundle in the width direction (in the direction perpendicular to the sheet conveying direction), and the movable fence 210 and the rear end hitting claw 221 align the sheet bundle in the conveying direction. In this manner, aligning operations of the sheet bundle SB in the width direction and the conveying direction are completed. Before these operations for aligning the sheets are performed, the amounts by which the sheet bundle SB is pushed by the rear end hitting claw 221 and the saddle stitching jogger fences 225, respectively, are adjusted to most appropriate values based on the information of the sheet size, information of the number of sheets in the sheet bundle, and information of the thickness of the sheet bundle.

When the sheet bundle is thick, the space inside of the conveyance path becomes reduced. Therefore, there are often cases in which the sheet bundle cannot be completely aligned by performing these aligning operations only once. In such a case, the saddle-stitch book binding apparatus 2 increases the number of times by which the aligning operations are performed. In this manner, the sheet bundle can be better aligned.

When the number of sheets is larger, the time required for the sheets to be stacked sequentially on the upstream side is increased, and the time before the next sheet bundle SB is received becomes more extended. Therefore, no time loss is incurred even if the number of times the aligning operations are performed is increased. As a result, a sheet bundle can be better aligned efficiently. It is also possible to control the number of times the aligning operations are performed based on the time required in the upstream-side processing.

Note that the stand-by position of the movable fence 210 is normally set at a position where the saddle stitch position of the sheet bundle SB faces the stitch position of the saddle stitching stapler S1. This allows the sheet bundle to undergo the stitching process where it is stacked without moving the movable fence 210 to the saddle stitch position of the sheet bundle SB. Now, at the stand-by position, a stitcher of the saddle stitching stapler S1 is driven in a direction indicated by an arrowed line "b" to the center part of the sheet bundle SB and performs the stitching process with a clincher, thereby saddle stitching the sheet bundle SB.

The positioning of the movable fence 210 is determined based on pulse control of the movable fence HP sensor 292, and the positioning of the rear end hitting claw 221 is determined based on pulse control of the rear end hitting claw HP sensor 294. The control for positioning the movable fence 210 and the rear end hitting claw 221 is executed by a central processing unit (CPU) in a control circuit not illustrated included in the saddle-stitch book binding apparatus 2.

Figure 4:
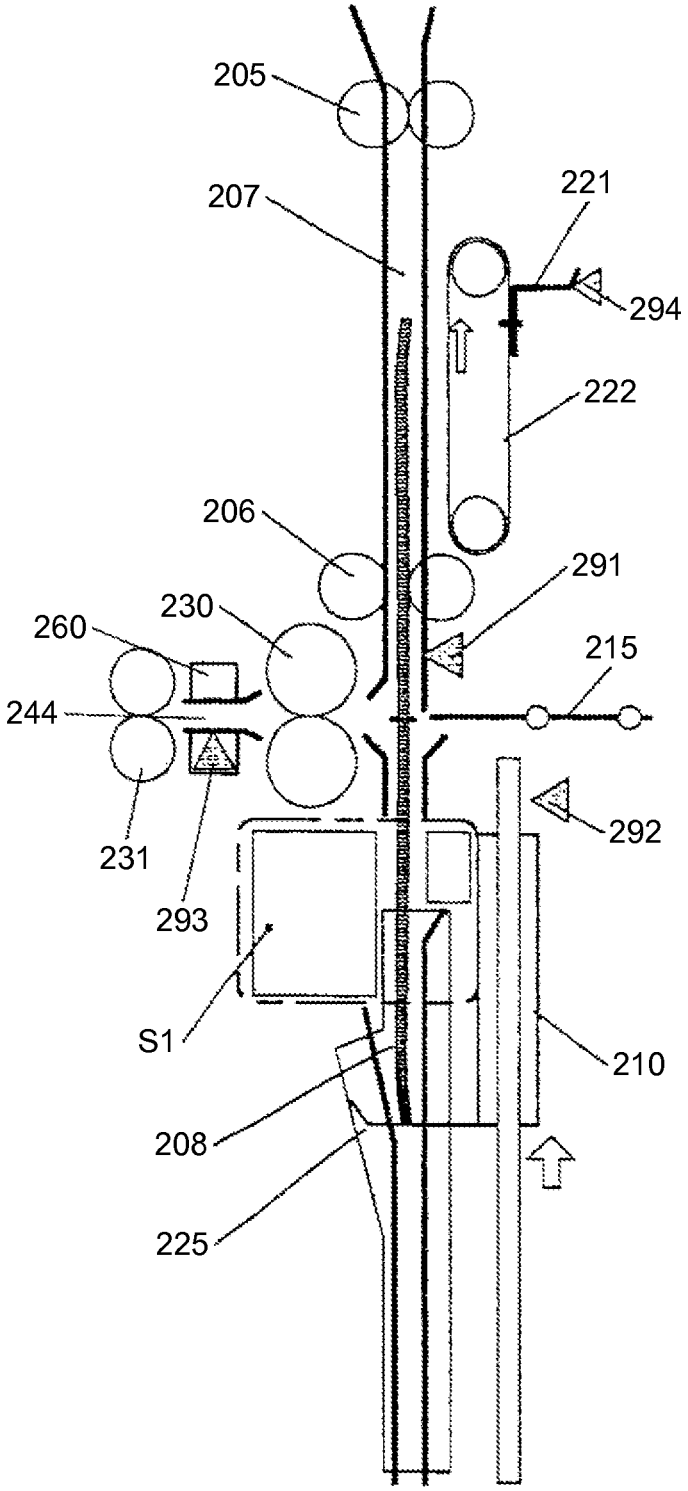
FIG. 4 is a diagram explaining an operation performed by the saddle-stitch book binding apparatus when the conveyance of the sheet bundle to a center folding position is completed.

The sheet bundle SB that is saddle stitched as illustrated in FIG. 3 is now transported to a position at which the saddle stitch position (the center position of the sheet bundle SB in the conveyance direction) faces the folding plate 215 along the upward movement of the movable fence 210 while the pressurization by the lower bundle conveyance roller 206 is released, as illustrated in FIG. 4. This position as well is controlled on the basis of a position detected by the movable fence HP sensor 292.

Figure 5:
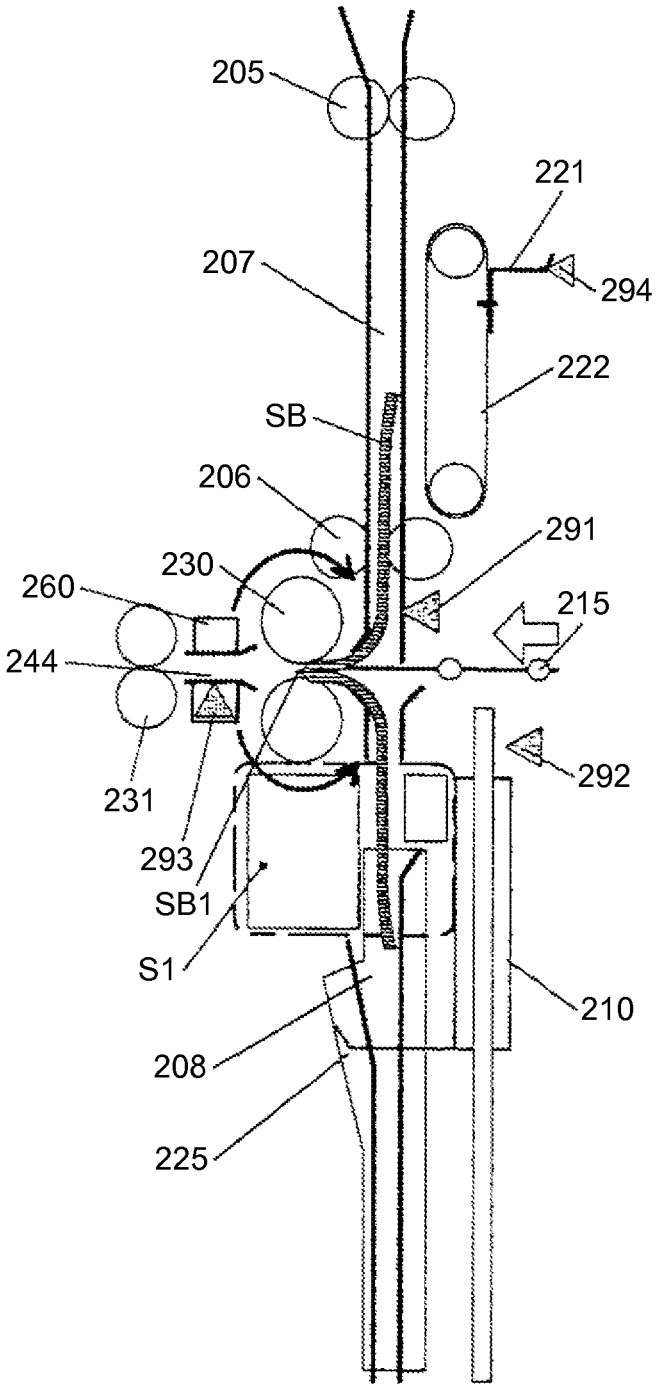
FIG. 5 is a diagram for explaining an operation performed by the saddle-stitch book binding apparatus when a center folding process is to be applied to the sheet bundle.

When the sheet bundle SB reaches the position illustrated in FIG. 4, the folding plate 215 is caused to move toward the nip of the folding roller pair 230, to abut against the sheet bundle SB near the staples binding the sheet bundle SB from a direction approximately perpendicular to the sheet bundle SB, and to push sheet bundle SB, as illustrated in FIG. 5. The sheet bundle SB is pushed by the folding plate 215, guided into the nip of the folding roller pair 230, and pushed into the nip of the folding roller pair 230 already rotating. The folding roller pair 230 presses and conveys the sheet bundle SB pushed into the nip of the folding roller pair 230. This pressing and conveying operation enables the sheet bundle SB to be folded along the center, and a simple-bounded sheet bundle SB is formed. FIG. 5 illustrates a configuration in which the leading edge of the fold line portion SB1 of the sheet bundle SB is nipped in and pressed by the nip of the folding roller pair 230.

Figure 6:
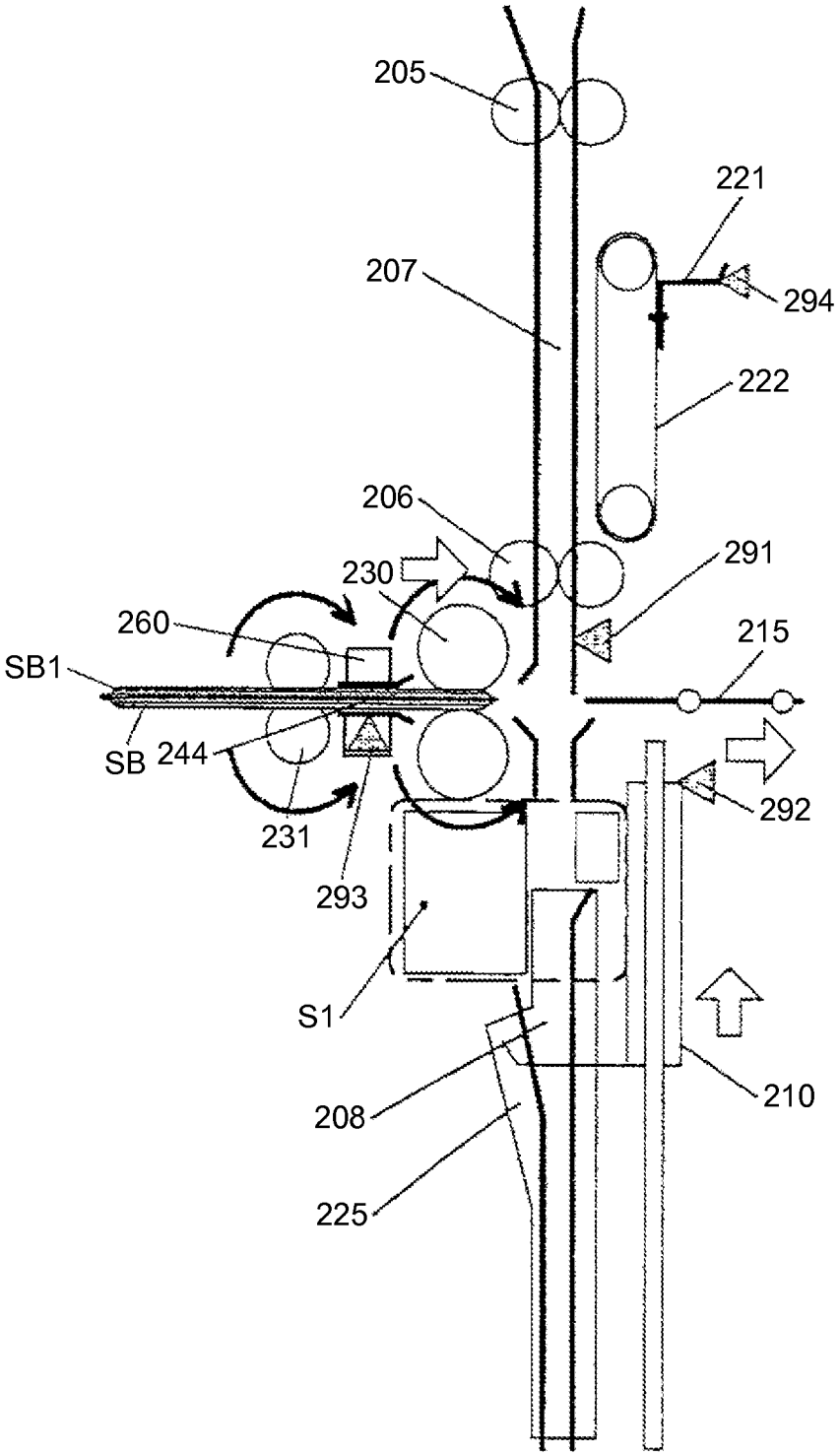
FIG. 6 is a diagram explaining an operation performed by the saddle-stitch book binding apparatus when the center-folded sheet bundle is discharged.

The sheet bundle SB folded in half at the center as illustrated in FIG. 5 is conveyed by the folding roller pair 230 as the sheet bundle SB, as illustrated in FIG. 6, becomes nipped between the lower discharging rollers 231, and is discharged to the subsequent stage. When the fold line portion passage sensor 293 detects the rear end of the sheet bundle SB, the folding plate 215 and the movable fence 210 are returned to their respective home positions, and the lower bundle conveyance rollers 206 start applying pressure to each other to prepare for conveyance of the next sheet bundle SB. If the next job is for a sheet bundle having the same size and the same number of sheets, the movable fence 210 may return to and be kept standby at the position illustrated in FIG. 2. The control described above is also executed by the CPU in the control circuit.

Figure 7:
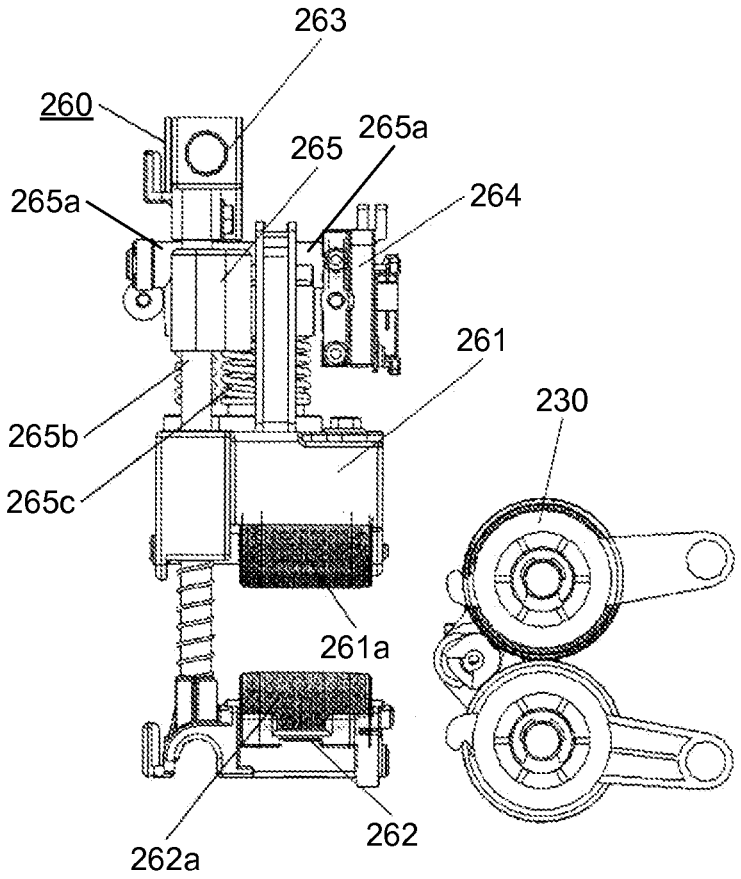
FIG. 7 is a front view of a relevant portion of basic structures of an additional folding roller unit and a folding roller pair.
Figure 8:
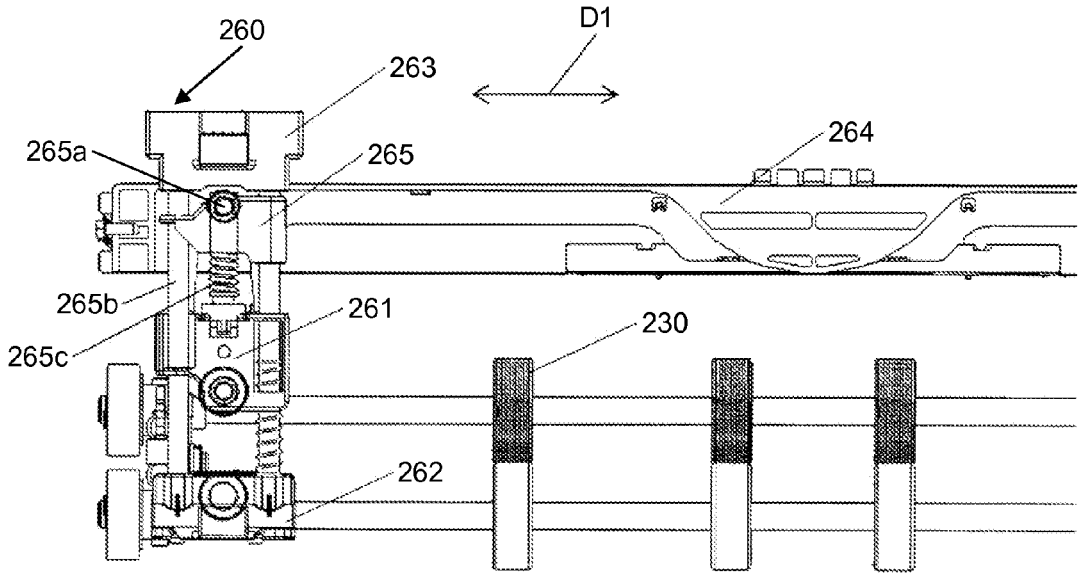
FIG. 8 is a side view of the relevant portion illustrated in FIG. 7 viewed from the left side.

FIG. 7 is a front view of a relevant portion of basic structures of the additional folding roller unit and the folding roller pair. FIG. 8 is a side view of the relevant portion illustrated in FIG. 7 viewed from the left side. The additional folding roller unit 260 is provided to the discharging conveyance path 244 between the folding roller pair 230 and the lower discharging rollers 231, and includes a unit carriage mechanism 263, a guiding member 264, and a pressing mechanism 265. A driving source and a driving mechanism not illustrated cause the unit carriage mechanism 263 to reciprocate the additional folding roller unit 260 in the depth direction in FIG. 7 along the guiding member 264 (the direction perpendicular to the sheet conveying direction). The pressing mechanism 265 is a mechanism that presses the sheet bundle SB by vertically applying pressure, and includes an upper additional folding roller unit 261 and a lower additional folding roller unit 262.

The upper additional folding roller unit 261 is supported by a support member 265*b* movably in the vertical directions with respect to the unit carriage mechanism 263, and the lower additional folding roller unit 262 is mounted immovably at the lower end of the support member 265*b* of the pressing mechanism 265. An upper additional folding roller 261*a* in the upper additional folding roller unit 261 can be pressed against a lower additional folding roller 262*a*, and the sheet bundle SB is nipped between and pressed by these two additional folding rollers. The pressure is applied by a pressing spring 265*c* that presses the upper additional folding roller unit 261 with its elastic force. The pressing mechanism 256 is carried in the width direction (in the direction indicated by the arrowed line D1 in FIG. 8) of the sheet bundle SB while pressing the sheet bundle SB, in the manner to be explained later, and provides additional folding to a fold line portion SB1.

Figure 9:
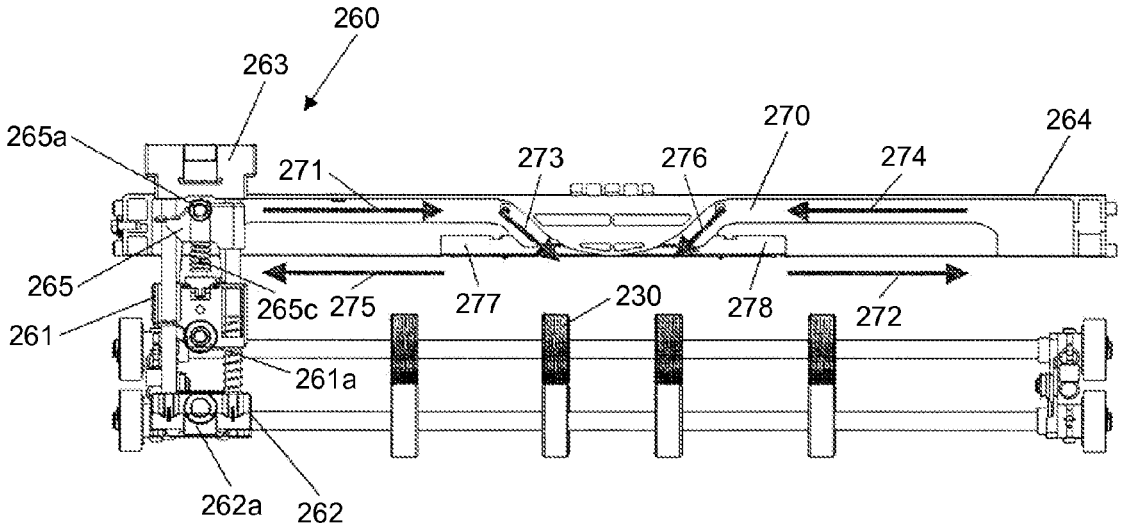
FIG. 9 is a detailed diagram illustrating a guiding member.

FIG. 9 is a detailed schematic of the guiding member 264. The guiding member 264 includes a guiding path 270 by which the additional folding roller unit 260 is guided in the width directions of the sheet bundle SB. The following six paths are defined in the guiding path 270:

1) a first guiding path 271 that guides the pressing mechanism 265 while being carried forwardly along a non-pressing position;

2) a second guiding path 272 that guides the pressing mechanism 265 while being carried forwardly along a pressing position;

3) a third guiding path 273 that switches the pressing mechanism 265 being carried forwardly from the non-pressing position to the pressing position;

4) a fourth guiding path 274 that guides the pressing mechanism 265 while being carried reversely along the non-pressing position;

5) a fifth guiding path 275 that guides the pressing mechanism 265 while being carried reversely along the pressing position; and 6) a sixth guiding path 276 that switches the pressing mechanism 265 being carried reversely from the non-pressing position to the pressing position.

Figure 10:
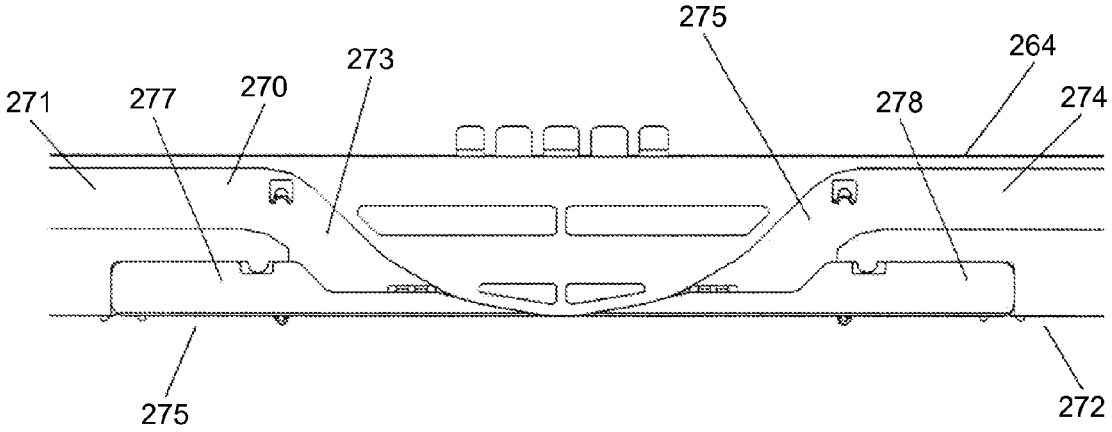
FIG. 10 is an enlarged view of the relevant portion illustrated in FIG. 9 before path switching claws are switched.
Figure 11:
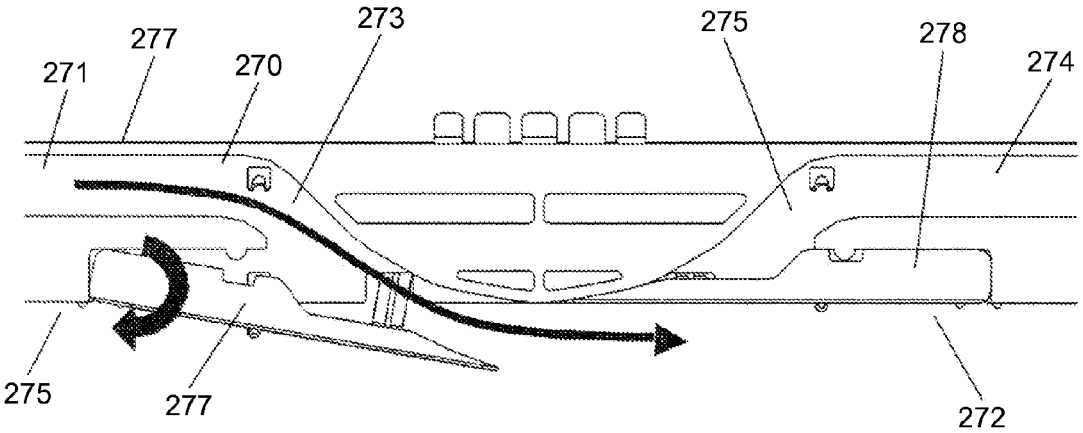
FIG. 11 is an enlarged view of the relevant portion illustrated in FIG. 9 after a first path switching claw is switched.

FIGS. 10 and 11 are enlarged views of the relevant portion illustrated in FIG. 9. A first path switching claw 277 and a second path switching claw 278 are provided at an intersection between the third guiding path 273 and the second guiding path 272 and an intersection between the sixth guiding path 276 and the fifth guiding path 275, respectively, as illustrated in FIGS. 10 and 11. The first path switching claw 277 can switch the path from the third guiding path 273 to the second guiding path 272, as illustrated in FIG. 11. The second path switching claw 278 can switch the path from the sixth guiding path 276 to the fifth guiding path 275. The former is incapable of switching the path from the second guiding path 272 to the third guiding path 273, and the latter is incapable of switching the path from the fifth guiding path 275 to the sixth guiding path 276. In other words, the path switching claws are configured to not be able to switch a path in a reverse direction. Note that an arrowed line illustrated in FIG. 11 indicates a locus of movement of a guide pin 265*a* included in the pressing mechanism 265 (see FIG. 7).

The pressing mechanism 265 is carried along the guiding path 270 because the guide pin 265*a* in the pressing mechanism 265 is movably and loosely fitted into the guiding path 270. In other words, the guiding path 270 functions as a cam groove, and the guide pin 265*a* functions as a cam follower being displaced as the guide pin 265*a* is carried along the cam groove.

FIGS. 12 to 22 are schematics for explaining an operation of providing additional folding performed by the additional folding roller unit according to the embodiment.

Figure 12:
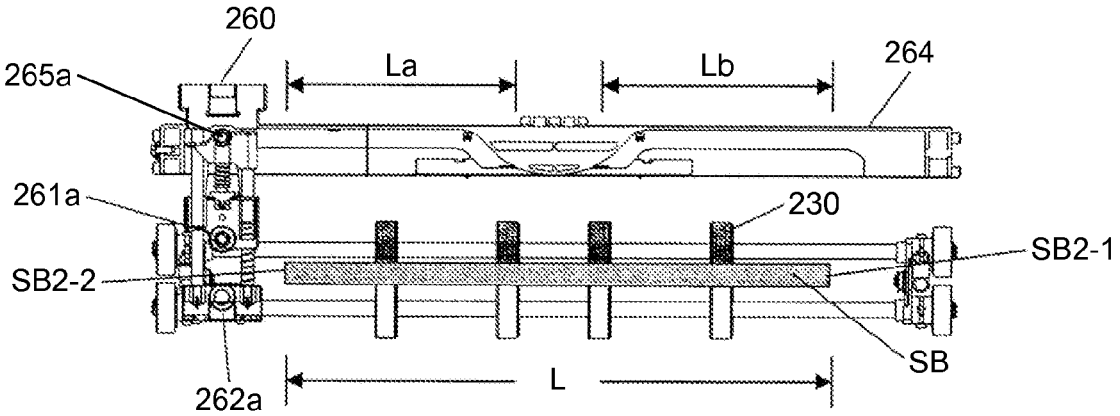
FIG. 12 is a diagram explaining an initial position of an additional folding operation.

FIG. 12 illustrates a configuration in which the sheet bundle SB folded by the folding roller pair 230 is conveyed and stops at the predetermined additional folding position, and the additional folding roller unit 260 is positioned at the standby position. This configuration is the initial position for the additional folding operation.

Figure 13:
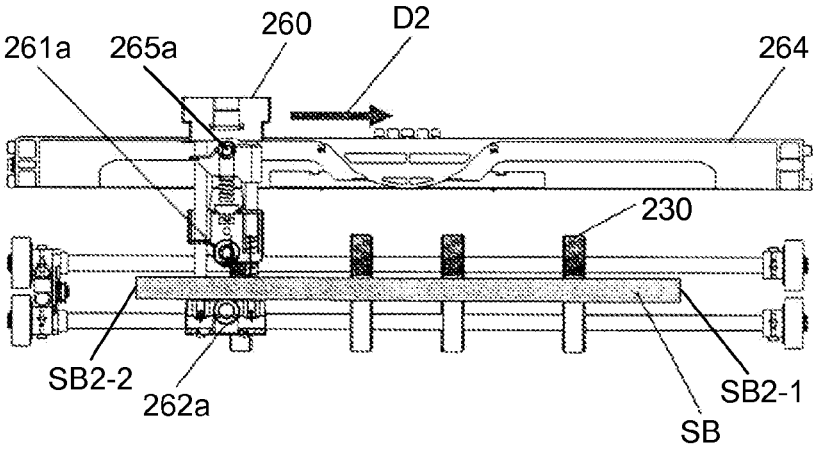
FIG. 13 is a diagram explaining an operation when the additional folding roller unit starts being carried forwardly.
Figure 14:
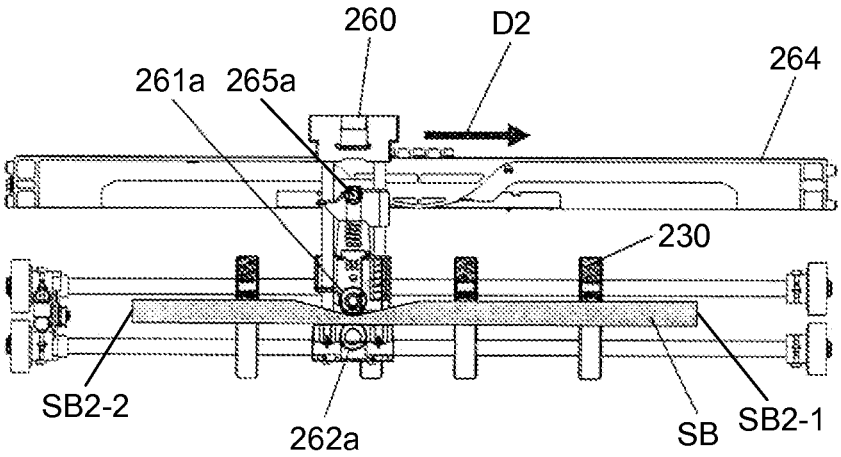
FIG. 14 is a diagram explaining an operation when the additional folding roller unit enters a third guiding path near the center of the sheet bundle.

The additional folding roller unit 260 starts being carried forwardly from the initial position (FIG. 12) to the right in FIG. 13 (in the direction indicated by the arrowed line D2) (FIG. 13). At this time, the pressing mechanism 265 in the additional folding roller unit 260 is carried along the guiding path 270 in the guiding member 264, by the action of the guide pin 265*a*. Immediately after the operation is started, the pressing mechanism 265 is carried along the first guiding path 271. At this time, the additional folding roller pair 261*a* and 262*a* are at the non-pressing position. The non-pressing position herein means a position at which the additional folding roller pair 261*a* and 262*a* is brought into contact with the sheet bundle SB but applies almost no pressure to the sheet bundle SB, or a position in which the additional folding roller pair 261*a* and 262*a* is kept away from the sheet bundle SB. The additional folding roller pair 261*a* and 262*a* includes the upper additional folding roller 261*a* and the lower additional folding roller 262*a* making up a pair.

Figure 15:
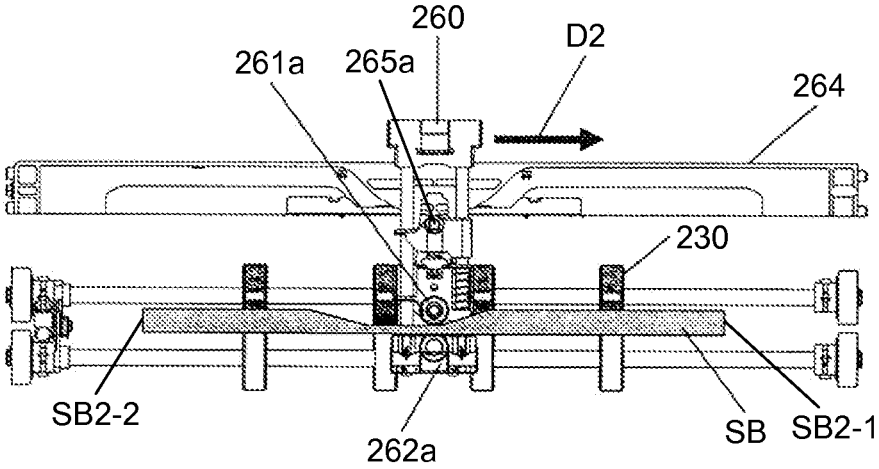
FIG. 15 is a diagram explaining an operation when the additional folding roller unit pushes the first path switching claw away and enters a second guiding path.

When the additional folding roller unit 260 approaches the third guiding path 273 near the center of the sheet bundle SB (FIG. 14), the pressing mechanism 265 starts being lowered along the third guiding path 273, pushes the first path switching claw 277 away, and enters the second guiding path 272 (FIG. 15). At this time, the pressing mechanism 265 is at a position pressing the upper additional folding roller unit 261, whereby bringing the upper additional folding roller unit 261 into contact with the sheet bundle SB, and bringing the upper additional folding roller unit 261 to the pressing position.

Figure 16:
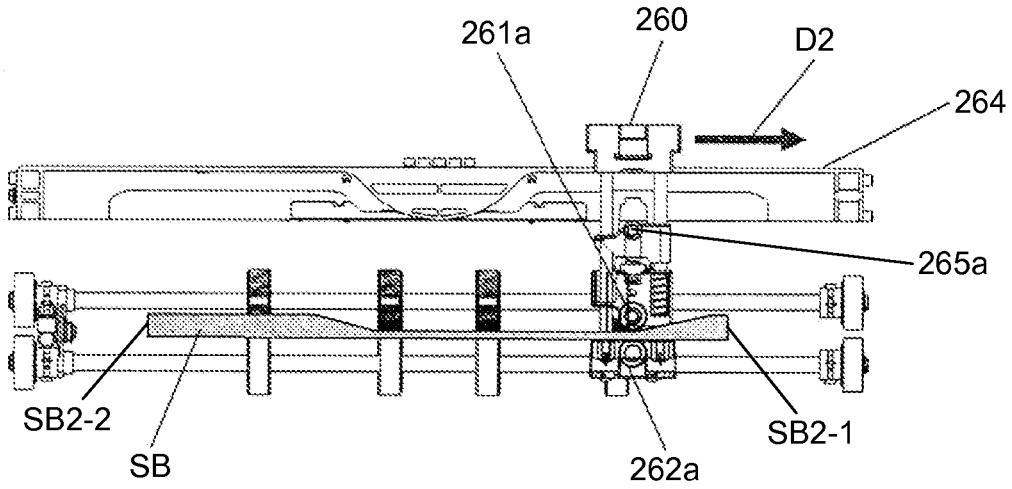
FIG. 16 is a is diagram explaining an operation when the additional folding roller unit is carried in a direction toward an end of the sheet bundle while pressing the sheet bundle.
Figure 17:
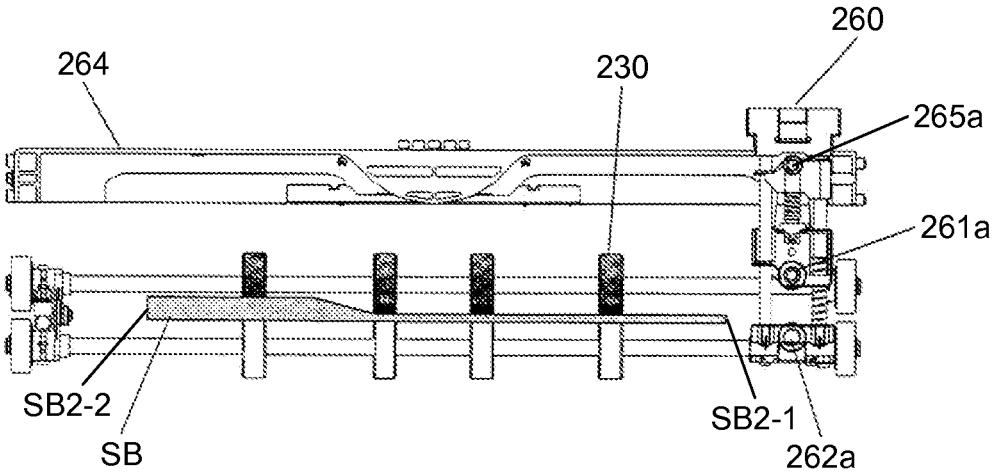
FIG. 17 is a diagram explaining an operation when the additional folding roller unit reaches a finishing point of the forward carriage along the second guiding path.

The additional folding roller unit 260 pressing the sheet bundle SB is then further carried in the direction of the arrow D2 (FIG. 16). Because the second path switching claw 278 cannot move in the opposite direction, the additional folding roller unit 260 is carried along the second guiding path 272, without entering the sixth guiding path 276, carried outside of the sheet bundle SB, and reaches the finishing point of the forward carriage (FIG. 17). Once the additional folding roller unit 260 is carried to this point, the guide pin 265*a* in the pressing mechanism 265 is carried from the second guiding path 272 into the fourth guiding path 274 positioned at a higher level. As a result, the positioning of the guide pin 265*a* becomes no longer restricted by the upper surface of the second guiding path 272, and the upper additional folding roller 261*a* is removed from the lower additional folding roller 262*a*, and brought into the non-pressing position.

Figure 18:
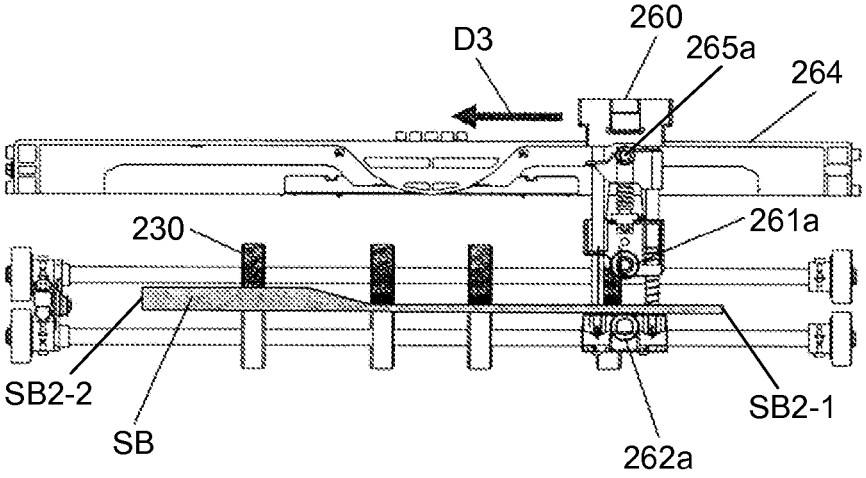
FIG. 18 is a diagram explaining an operation when the additional folding roller unit starts being carried reversely from the finishing point of the forward carriage.
Figure 19:
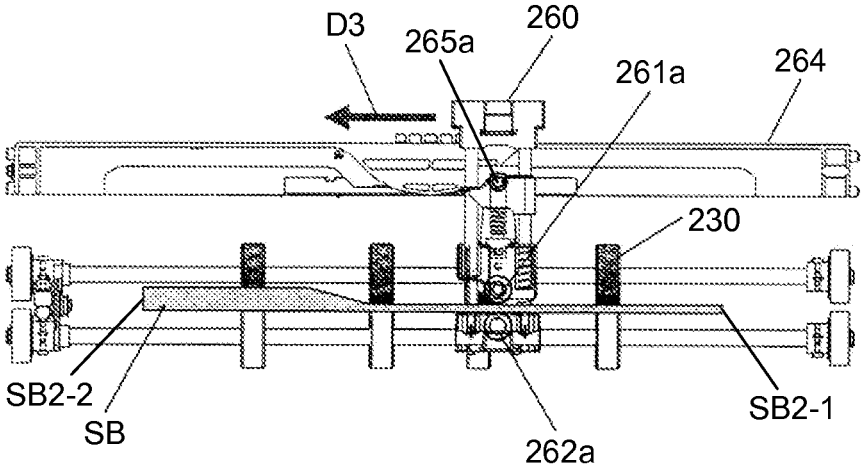
FIG. 19 is a diagram explaining an operation when the additional folding roller unit starts being carried reversely and reaches a sixth guiding path.
Figure 20:
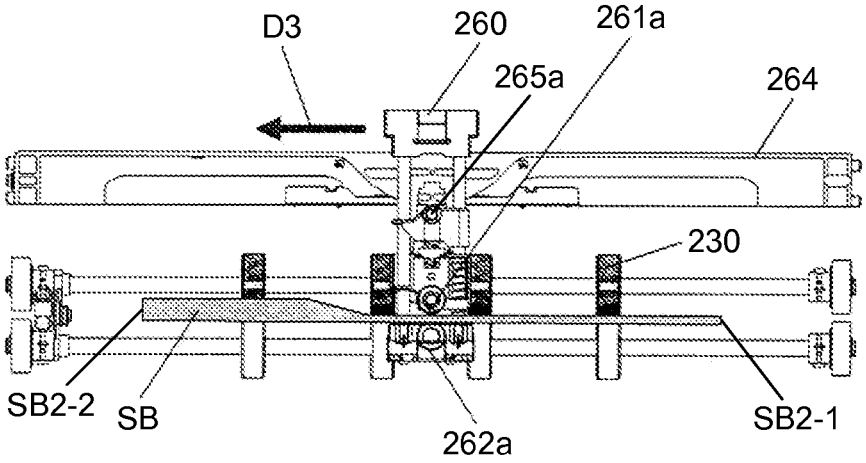
FIG. 20 is a diagram explaining an operation when the additional folding roller unit reaches the sixth guiding path and is moved to a pressing position from a non-pressing position.
Figure 21:
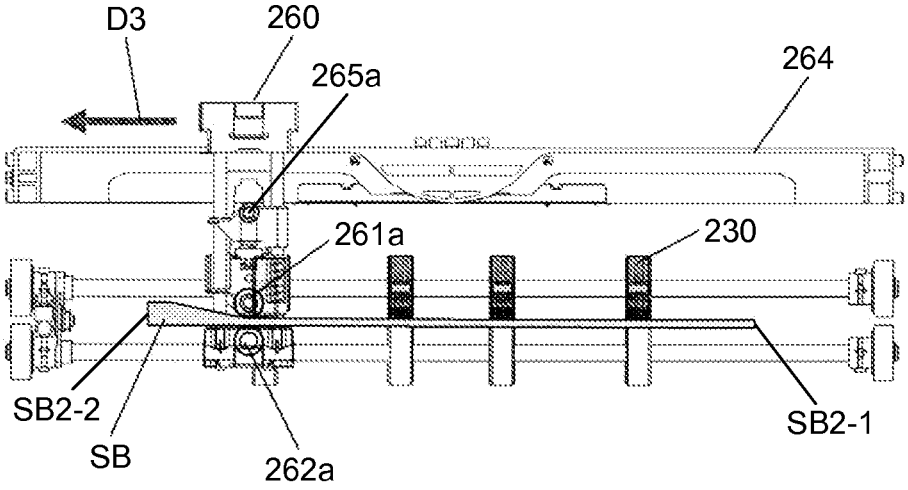
FIG. 21 is a diagram explaining an operation when the additional folding roller unit enters the sixth guiding sixth guiding path and is completely moved to the pressing position.

The unit carriage mechanism 263 then carries the additional folding roller unit 260 in a reverse direction (FIG. 18). In the reverse carriage, the pressing mechanism 265 is carried toward the left in FIG. 18 along the fourth guiding path 274 (in the direction indicated by the arrowed line D3). Once the pressing mechanism 265 reaches the sixth guiding path 276 (FIG. 19), the guide pin 265*a* follows the shape of the sixth guiding path 276 and is pressed downwardly, thereby moving the pressing mechanism 265 to the pressing position from the non-pressing position (FIG. 20). The reverse carriage is started from a position at a one end SB2-1 side of the position where the forward carriage was started.

Figure 22:
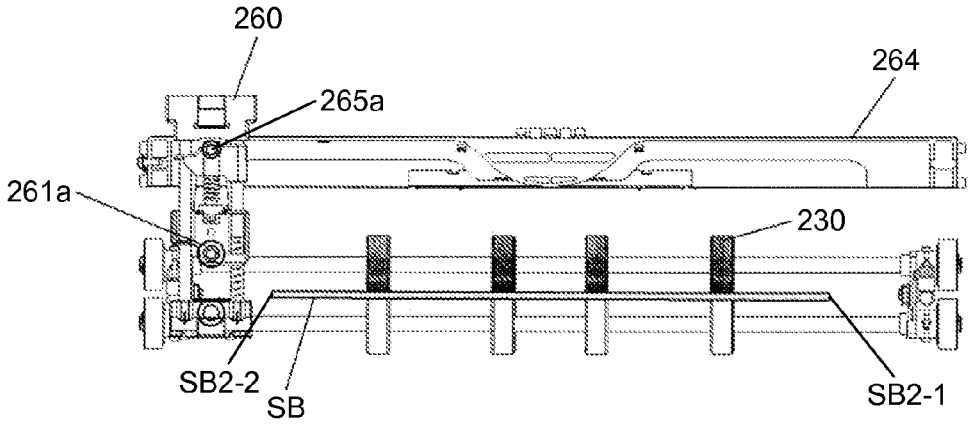
FIG. 22 is a diagram explaining an operation when the additional folding roller unit is kept carried through the fifth guiding path and returns to the initial position.

Once the guide pin 265*a* enters the fifth guiding path 275, the pressing mechanism 265 is completely brought to the pressing position. The pressing mechanism 265 is then carried along the fifth guiding path 275 in the direction of the arrow D3 (FIG. 21), and carried outside of the sheet bundle SB (FIG. 22).

The sheet bundle SB is thus provided with additional folding by the reciprocating movement of the additional folding roller unit 260. At this time, the additional folding roller unit 260 starts applying additional folding from the center toward the one end SB2-1 of the sheet bundle SB, and is carried outside of the one end SB2-1 of the sheet bundle SB. The additional folding roller unit 260 is then carried into the additional-folded part of the sheet bundle, starts providing additional folding from the center toward the other end SB2-2 of the sheet bundle, and is carried outside of the other end SB2-2. Through this operation, additional folding is provided to the sheet bundle SB.

By allowing the additional folding roller unit 260 to operate in the manner described above, before the additional folding roller unit 260 starts providing additional folding and when the additional folding roller unit 260 starts returning to the other end SB2-2 after being carried outside the one end SB2-1, the additional folding roller pair 261*a* and 262*a* is neither brought into contact with nor applies any pressure to the ends SB2 of the sheet bundle SB from outside of the sheet bundle SB. In other words, when the additional folding roller unit 260 is carried across the ends SB2-1 and 2-2 of the sheet bundle SB from the outsides of the ends SB2-1 and 2-2, the additional folding roller unit 260 is kept at the non-pressing position. Therefore, the ends SB2-1 and 2-2 of the sheet bundle SB are not damaged. Furthermore, because additional folding is applied from near the center toward the end SB2-1 (SB2-1) of the sheet bundle SB, the distance by which the additional folding roller unit 260 is carried in contact with the sheet bundle SB to provide additional folding can be reduced, and a waviness possibly resulting in a wrinkle is less accumulated. Therefore, when additional folding is applied to the fold line portion (spine) SB1 of the sheet bundle SB, the ends SB2-1 and 2-2 of the sheet bundle SB are not damaged, and turns or wrinkles of the fold line portion SB1 and portions near the fold line portion SB1 resulting from accumulation of the waviness can be reduced.

In order to prevent the additional folding roller pair 261*a* and 262*a* from rolling over the ends SB2-1 and SB2-2 of the sheet bundle SB from the outside of each of the ends SB2-1 and SB2-2, the additional folding roller unit 260 is caused to operate in the manner illustrated in FIGS. 12 to 22. In other words, when La denotes a distance by which the additional folding roller unit 260 is carried above the sheet bundle SB forwardly without pressing the sheet bundle SB, and Lb denotes a distance by which the additional folding roller unit 260 is carried above the sheet bundle reversely without pressing the sheet bundle SB, a relation between the width direction length L of the sheet bundle, and the distances La and Lb satisfy the following (FIGS. 12 to 14, FIGS. 17 to 19).

$$L>La\pm Lb$$

Moreover, it is desired that the pressing be started near the center part of the sheet bundle SB in the width direction thereof by setting the distances La and Lb roughly the same (FIGS. 16 and 20).

The additional folding roller unit 260 according to the embodiment is provided with the lower additional folding roller unit 262 to provide additional folding using the additional folding roller pair 261*a* and 262*a*. However, it is also possible to remove the lower additional folding roller unit 262, and to provide the upper additional folding roller unit 261 and a bearer member not illustrated having an abutting surface facing the upper additional folding roller unit 261, and to allow these two members to press the sheet bundle SB.

Furthermore, in the additional folding roller unit 260 according to the embodiment, the upper additional folding roller unit 261 is structured movably in the vertical directions, and the lower additional folding roller unit 262 is structured immovably in the vertical directions. However, it is also possible to structure the lower additional folding roller unit 262 to be also movable in the vertical directions. Such a structure allows the additional folding roller pair 261*a* and 262*a* to be brought into contact and separated from each other symmetrically with respect to the additional folding position. Therefore, the additional folding position can be kept constant regardless of the thickness of the sheet bundle SB, and damages such as a scratch can be reduced.

Figure 23:
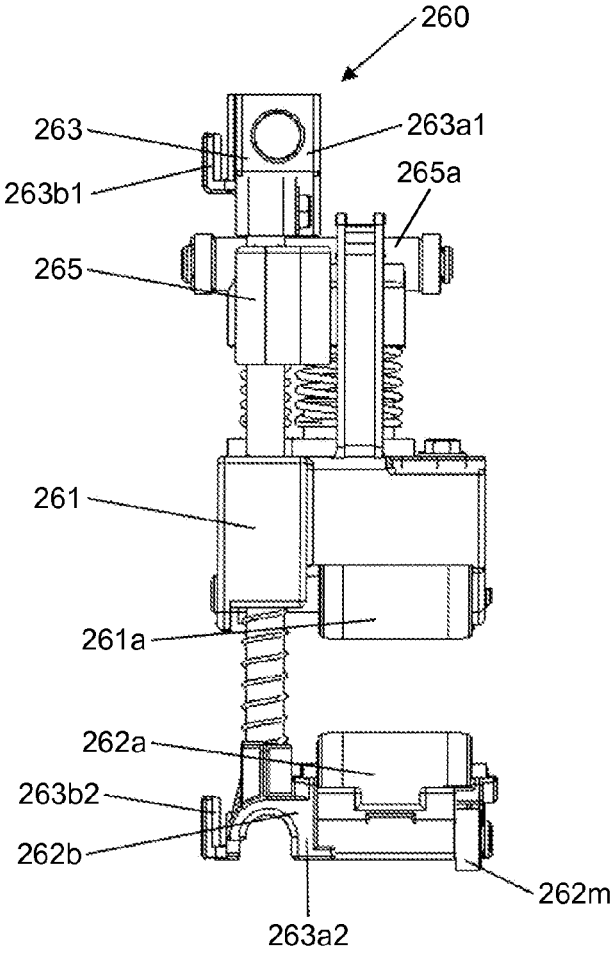
FIG. 23 is a front view of an additional folding unit according to the embodiment.
Figure 24:
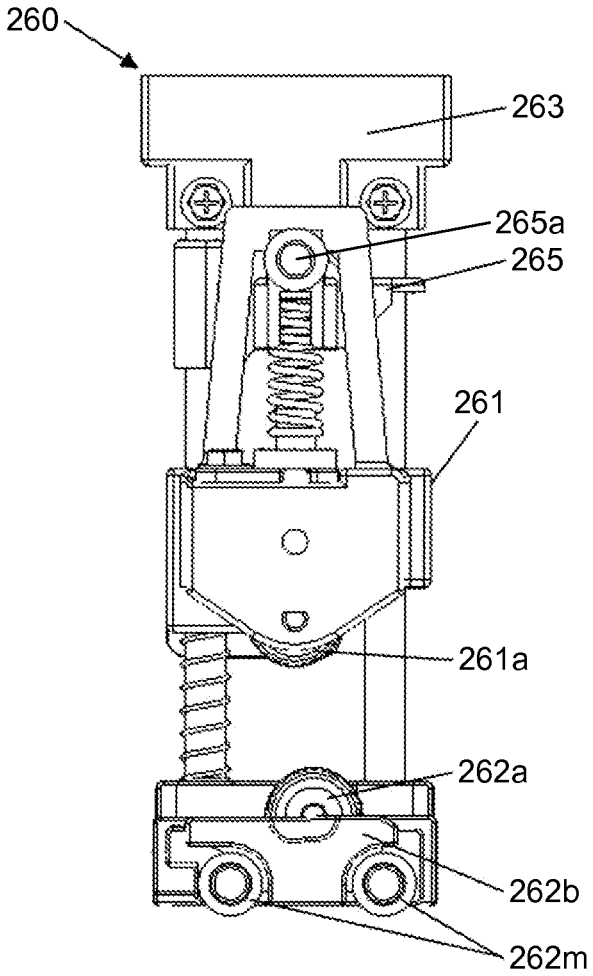
FIG. 24 is a side view of FIG. 23 viewed from the right side.

FIG. 23 is a front view of the additional folding roller unit 260 according to the embodiment. FIG. 24 is a side view of FIG. 23 viewed from the right side. The additional folding roller unit 260 illustrated in FIGS. 23 and 24 has the same basic structure as that of the additional folding roller unit 260 illustrated in FIGS. 7 and 8, and the parts that are the same or can be considered equivalent are assigned with the same reference numerals, and redundant explanations thereof are omitted hereinafter.

In FIGS. 23 and 24, provided to the lower end of the additional folding roller unit 260 are a roller holder 262*b* that fixes and holds the lower additional folding roller 262*a* in the vertical directions, and carriage rollers 262*m* mounted on the roller holder 262*b*.

Figure 25:
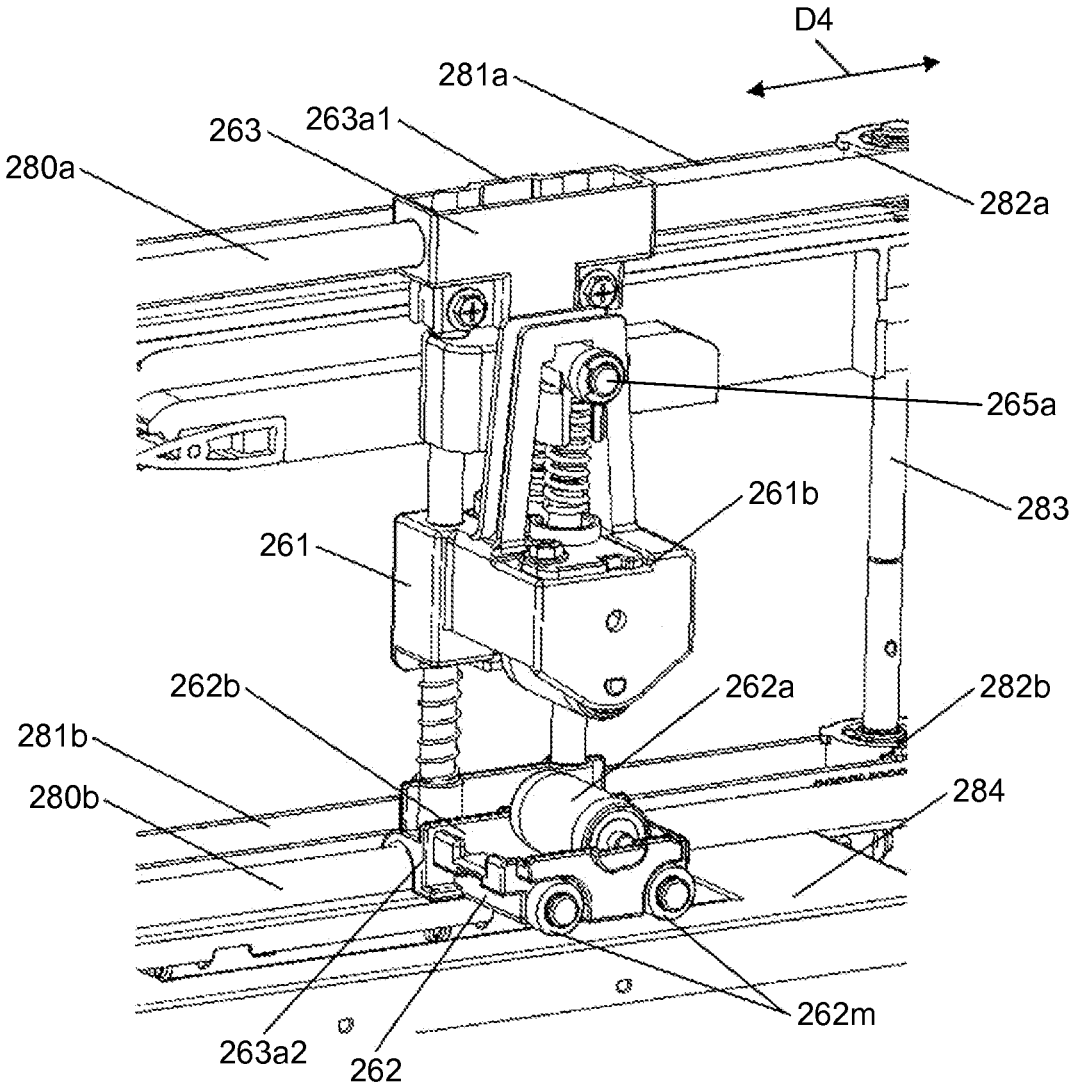
FIG. 25 is a perspective view of a relevant portion of a carriage mechanism in the additional folding roller unit.

FIG. 25 is a perspective view of a relevant portion of the unit carriage mechanism 263 provided to the additional folding roller unit 260. As mentioned earlier, the unit carriage mechanism 263 reciprocates the additional folding roller unit 260 in the depth directions in FIG. 23 (the direction perpendicular to the sheet conveying direction) along the guiding member 264, using the driving source and the driving mechanism not illustrated.

The additional folding roller unit 260 is carried along the guiding member 264. The reciprocating movement is guided by an upper guiding shaft 280*a* and a lower guiding shaft 280*b*. In other words, the unit carriage mechanism 263 includes not only the guiding member 264, but also the upper guiding shaft 280*a* and the lower guiding shaft 280*b*, an upper driving belt 281*a* and a lower driving belt 281*b* each of which is a timing belt, a pair of right and left upper pulleys 282*a* and a pair of right and left lower pulleys 282*b* in the drawing illustrating driving of the driving belts 281*a* and 281*b*, connecting shafts 283 coaxially connecting the right upper pulley 282*a* to the right lower pulley 282*b* and connecting the left upper pulley 282*a* to the left lower pulley 282*b*, respectively. In FIG. 25, the left pulleys and the left connecting shaft are not illustrated. The upper pulleys 282*a*, the lower pulleys 282*b*, and the connecting shafts 283 are driven by a motor not illustrated, and drive the upper driving belt 281*a* and the lower driving belt 281*b* synchronously.

The additional folding roller unit 260 includes an upper slider member 263*a*1 and a lower slider member 263*a*2 respectively having a belt fitting portion 263*b*1 and a belt fitting portion 263*b*2 to which the upper driving belt 281*a* and the lower driving belt 281*b* are respectively fitted. In this manner, when the upper pulleys 282*a* and the lower pulleys 282*b* are driven by a motor not illustrated, the driving belts 281*a* and 281*b* are caused to reciprocate in the width direction of the sheet bundle SB (in the directions indicated by the arrowed line D4 in FIG. 25), synchronously with the rotations of the pulleys 282*a* and 282*b*.

The upper slider member 263*a*1 is slidably mounted on the upper guiding shaft 280*a*, and supported by the upper guiding shaft 280*a* in such a manner that the moving directions of the upper slider member 263*a*1 are guided by the upper guiding shaft 280*a*. Similarly, the lower driving belt 281*b* can carry the roller holder 262*b* in the lateral directions. The lower slider member 263*a*2 is slidably mounted on the lower guiding shaft 280*b*, and supported by the lower guiding shaft 280*b* in such a manner that the moving directions of the lower slider member 263*a*2 are guided by the lower guiding shaft 280*b*, in the same manner as for the upper slider member 263*a*1. The lower slider member 263*a*2 is provided as a part of the roller holder 262*b*.

The carriage rollers 262*m* that are rotating members mounted at the bottom of the roller holder 262*b* are kept in contact with the top surface of a stay 284 that is a part of the structure of the saddle-stitch book binding apparatus 2, and are configured to roll on the top surface of the stay 284 while receiving the weight of the additional folding roller unit 260. This structure allows the carriage rollers 262*m* to roll on the top surface of the stay 284, whereby allowing the carriage rollers 262*m* to be carried smoothly, as the additional folding roller unit 260 is carried in the direction indicated by the arrowed line D4 in FIG. 25 when the driving belts 281*a* and 281*b* are moved.

In the manner described above, in the embodiment, the roller holder 262*b* is not only supported and guided by the lower guiding shaft 280*b*, but also by the stay 284. By supporting the additional folding roller unit 260 with the above three member in the manner described above, the load is distributed so that the load applied on the guiding shaft 602 can be reduced. As a result, the upper guiding shaft 280*a* and the lower guiding shaft 280*b* can be prevented from bending. Such a structure can prevent a pressure shortage caused because the guiding shaft 280*a* and the lower guiding shaft 280*b* are bent, and the pressure can be stabilized.

Figure 26:
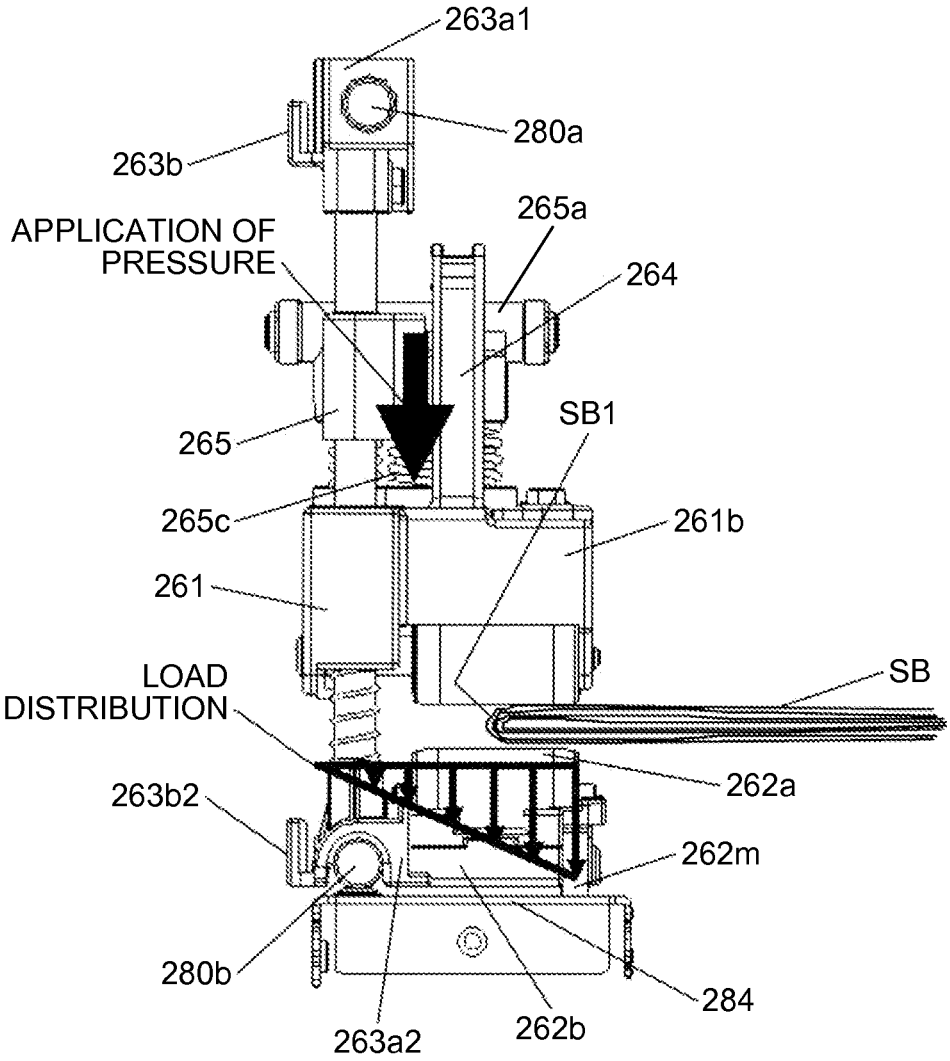
FIG. 26 is a diagram explaining a configuration in which the additional folding roller unit is pressing the sheet bundle.

FIG. 26 is a schematic for explaining a configuration of the additional folding roller unit 260 pressing the sheet bundle SB. As illustrated in FIG. 25, the carriage rollers 262*m* are provided on the upstream side of the upper guiding shaft 280*a* and the lower guiding shaft 280*b* in the sheet conveying direction. In this configuration, the sheet bundle SB is pressed at a position between the carriage rollers 262*m* and the guiding shafts 280*a* and 280*b*. When the pressure is applied to the sheet bundle SB in this configuration, a higher load is distributed to the carriage rollers 262*m*, so that the stay 284 is allowed to receive the higher load. When the higher load is distributed to the stay 284, the load applied to the guiding shafts 280*a* and 280*b* is reduced. Therefore, bending of the guiding shaft 602 can be prevented, so that the pressure shortage can be prevented. In this manner, the pressure can be stabilized.

Figure 27:
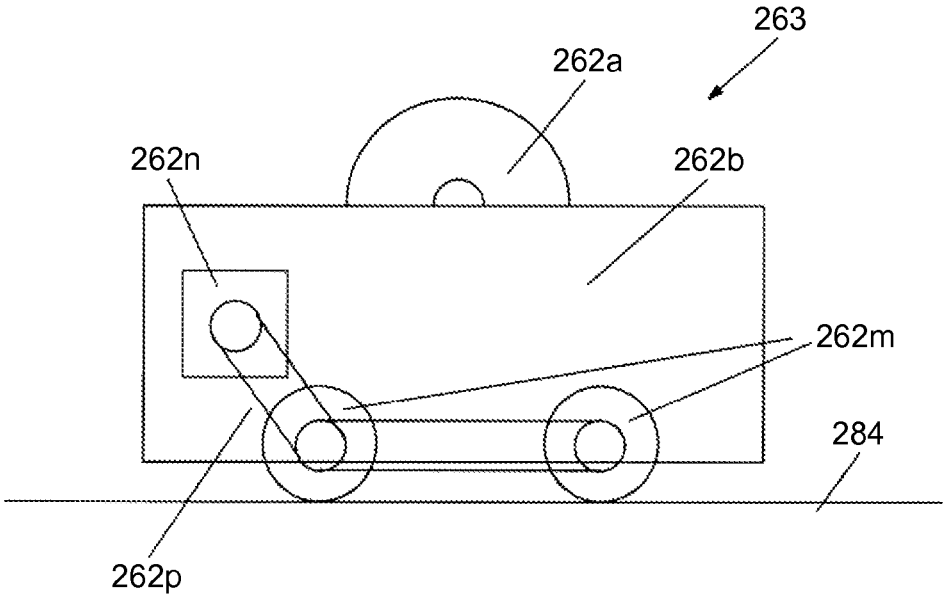
FIG. 27 is a schematic of an example in which the carriage mechanism in the additional folding roller unit is configured to move on its own.

In the example illustrated in FIG. 25, the additional folding roller unit 260 is reciprocated by causing the driving belts 281*a* and 281*b* to be driven. However, a motor for driving the carriage rollers 262*m* may be provided, instead of the driving belts 281*a* and 281*b*. In this manner, the additional folding roller unit 260 is allowed to move on its own. FIG. 27 is a general schematic illustrating this example. In the example illustrated in FIG. 27, a driving motor 262*n* is mounted on the roller holder 262*b*, and the driving force of the driving motor 262*n* is communicated to the carriage rollers 262*m* via a driving force communicating mechanism 262*p* including a timing belt and a pulley, to drive the carriage rollers. Such a structure can simplify the mechanism for carrying the additional folding roller unit 260, compared with the example illustrated in FIG. 25.

Figure 28:
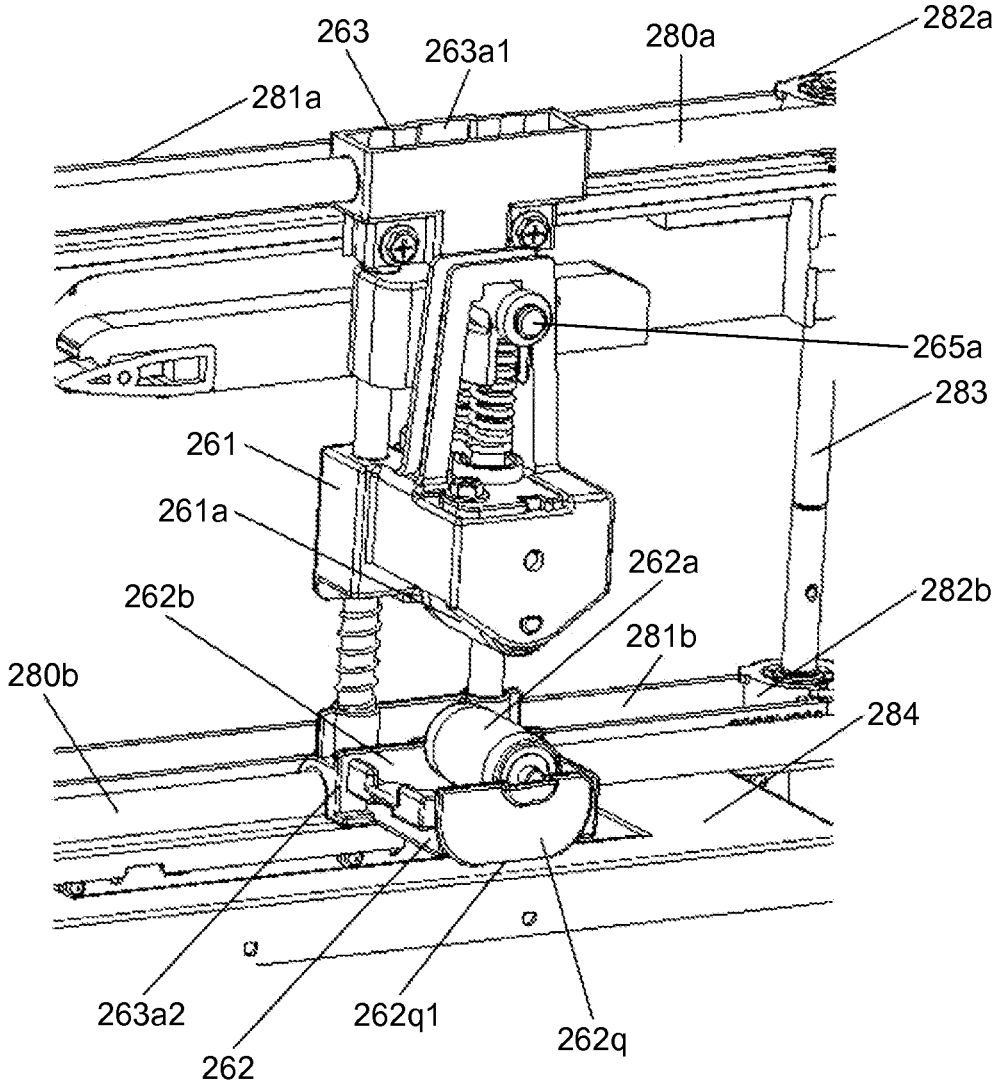
FIG. 28 is a diagram illustrating an example in which the carriage mechanism of the additional folding roller unit is configured to slide.

FIG. 28 is a perspective view of a relevant portion of another example of the unit carriage mechanism 263 of the additional folding roller unit 260.

In the example illustrated in FIG. 25, the carriage rollers 262*m* are configured to roll on the stay 284. The unit carriage mechanism 263 may use another structure that slides, instead of a structure with rollers. Such an example is illustrated in FIG. 28. In the example illustrated in FIG. 28, a side plate of the roller holder 262*b* on the upstream side in the sheet bundle conveying direction in FIG. 25 is configured as a sliding member 262*q*, and is provided in a manner directly brought into contact with the stay 284, as a sliding portion 262*q*1 that moves by allowing the bottom end surface of the sliding portion 262*q*1 to slide on the stay 284. This structure allows the sliding portion 262*q*1 to move by sliding on the stay 284, while allowing the sliding member 262*q* of the roller holder 262*b* to receive the weight of the additional folding roller unit 260. In order to prevent a load concentration on the sliding portion 262*q*1, it is preferable for the sliding portion 262*q*1 to have some length. In addition, in order to reduce the friction, resin coating, or metal coating with a small friction coefficient may be provided.

Such a structure can achieve a cost reduction because the bearings for rotatably supporting the carriage rollers 262*m* and the carriage rollers 262*m* are not required.

As described above, according the embodiment, the following advantageous effects can be achieved.

1) The saddle-stitch book binding apparatus 2 (sheet processing apparatus) includes the additional folding roller unit 260 (pressing unit) that presses the fold line portion SB1 of a folded sheet bundle SB so as to provide additional folding, the unit carriage mechanism 263 (carriage unit) that reciprocates the additional folding roller unit 260 in the width direction of the sheet bundle SB, the upper guiding shaft 280*a* and the lower guiding shaft 280*b* (guiding shaft) that support and guide the movement of the additional folding roller unit 260, and the carriage rollers 262*m* (supporting unit) that support the additional folding roller unit 260 and roll on the stay 284 (structure) provided to the saddle-stitch book binding apparatus 2. Therefore, the weight of the additional folding roller unit 260 can be distributed to the guiding shafts 280*a* and 280*b* and to the stay 284 so that the guiding shafts 280*a* and 280*b* can be prevented from bending. As a result, a pressure shortage caused by the bent guiding shafts 280*a* and 280*b* can be prevented, and the pressure can be stabilized while additional folding is provided to the fold line portion SB1 (spine) of the saddle-stitched sheet bundle SB (brochure).

2) The additional folding roller unit 260 includes the upper additional folding roller unit 261 (first pressing portion) and the lower additional folding roller unit 262 (second pressing portion) facing the upper additional folding roller unit 261. The upper additional folding roller unit 261 includes the pressing spring 265*c* (pressing member) pressing the upper additional folding roller unit 261 in a direction toward the lower additional folding roller unit 262 (in a direction toward the second pressing portion). The lower additional folding roller unit 262 includes the carriage rollers 262*m*. Therefore, the additional folding roller unit 260 can be carried in the width direction of the sheet bundle SB while applying pressure to the fold line portion SB1 of the sheet bundle SB between the upper additional folding roller unit 261 and the lower additional folding roller unit 262.

3) The guiding shaft includes an upper guiding shaft 280*a* (first guiding shaft) that guides the upper additional folding roller unit 261, and the lower guiding shaft 280*b* (second guiding shaft) that guide the lower additional folding roller unit 262. Therefore, the additional folding roller unit 260 can be carried precisely in a stable condition.

4) The carriage rollers 262*m* (supporting unit) that are rotating members are caused to roll on the stay 284. Therefore, the additional folding roller unit 260 can be moved with a smaller load.

5) The carriage roller 262*m* (supporting unit) is provided in plurality. Therefore, the load can be distributed and the additional folding roller unit 260 can be moved more stably.

6) The additional folding roller unit 260 includes the driving motor 262*n* that drives and moves the carriage rollers 262*m*, and the driving force communicating mechanism 262*p* (driving unit). Therefore, the additional folding roller unit 260 does not require any external driving mechanism, whereby allowing the size of the apparatus to be reduced.

7) The sliding member 262*q* sliding on the stay 284 is used as the supporting unit, instead of the carriage rollers 262*m*. Therefore, a cost reduction can be achieved.

8) The carriage rollers 262*m* or the sliding member 262*q* are provided on a more upstream side of the sheet bundle SB in the conveying direction than the position where the guiding shafts 280*a* and 280*b* are provided. Therefore, the load is distributed to the carriage rollers 262*m* or the sliding member 262*q*, whereby allowing the load on the guiding shafts 280*a* and 280*b* to be reduced. As a result, bending of the guiding shafts 280*a* and 280*b* can be reduced, and the pressure applied to the fold line portion SB1 can be stabilized.

9) During a forward carriage, the additional folding roller unit 260 starts pressing a predetermined position of the sheet bundle SB in the width direction (near the center of the sheet width), is carried outside of the one end SB2-1 of the sheet bundle SB, and stops pressing. During a reverse carriage, the additional folding roller unit 260 starts pressing at a position nearer to the one end SB2-1 than the predetermined position where the forward carriage was started, and is carried outside of the other end SB2-2 of the sheet bundle SB. Therefore, when the additional folding roller unit 260 presses the sheet bundle SB, the additional folding roller unit 260 carried from outside of the ends SB2-1 and SB2-2 of the sheet bundle SB is always kept in the non-pressing position. Hence, when additional folding is provided to the fold line portion SB1 of the sheet bundle, the ends SB2-1 and SB2-2 of the sheet bundle are not damaged. Furthermore, because additional folding is not provided to the entire length of the sheet bundle in the width direction at once, turning or wrinkling of the fold line portion and portions near the fold line portion caused by an accumulated waviness can be reduced.

In the claims, a sheet bundle corresponds to the reference numeral SB in the embodiment. A fold line portion corresponds to the reference numeral SB1. A pressing unit corresponds to the additional folding roller unit 260. A carriage unit corresponds to the unit carriage mechanism 263. A sheet processing apparatus corresponds to the saddle-stitch book binding apparatus 2. A guiding shaft corresponds to the upper guiding shaft 280*a* and the lower guiding shaft 280*b*. A structure corresponds to the stay 284. A supporting unit corresponds to the carriage rollers 262*m* or to the sliding member 262*q*. A first pressing portion corresponds to the upper additional folding roller unit 261. A second pressing portion corresponds to the lower additional folding roller unit 262. A pressing member corresponds to the pressing spring 265*c*. A first guiding shaft corresponds to the upper guiding shaft 280*a*. A second guiding shaft corresponds to the lower guiding shaft 280*b*. A driving unit corresponds to the driving motor 262*n* and the driving force communicating mechanism 262*p*. An end of the sheet bundle corresponds to the reference numeral SB2. An image forming system corresponds to a system including the saddle-stitch book binding apparatus 2 and the image forming apparatus PR.

According to one aspect of the present invention, the pressure can be stabilized when additional folding is provided to the spine of a saddle-stitched sheet bundle.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a pressing unit configured to provide additional folding to a fold line portion of a sheet bundle by pressing the fold line portion;

a carriage unit configured to reciprocate the pressing unit in width directions of the sheet bundle;

a guiding shaft configured to support the pressing unit and configured to guide movement of the pressing unit; and a supporting unit configured to support the pressing unit and configured to move on a structure provided to the sheet processing apparatus, the pressing unit including a first pressing portion and a second pressing portion that faces the first pressing portion, the first pressing portion including a pressing member configured to press the first pressing portion toward the second pressing portion, and the second pressing portion including the supporting unit.

2. The sheet processing apparatus according to claim 1, wherein the guiding shaft includes:

a first guiding shaft configured to guide the first pressing portion; and a second guiding shaft configured to guide the second pressing portion.

3. The sheet processing apparatus according to claim 1, wherein the supporting unit includes a rotating member configured to roll on a predetermined portion of the structure.

4. The sheet processing apparatus according to claim 1, wherein the supporting unit is provided in plurality.

5. The sheet processing apparatus according to claim 3, wherein the pressing unit includes a driving unit configured to drive the rotating member to move the supporting unit.

6. The sheet processing apparatus according to claim 1, wherein the supporting unit includes a sliding member configured to slide on a portion of the structure.

7. The sheet processing apparatus according to claim 1, wherein the supporting unit is positioned on an upstream side of the guiding shaft in a conveying direction of the sheet bundle.

8. The sheet processing apparatus according to claim 1, wherein during a forward carriage, the pressing unit is configured to start pressing from a position in a width direction of the sheet bundle, is carried outside of one end of the sheet bundle, and is configured to stop pressing, and during a reverse carriage, the pressing unit is configured to start pressing at a position nearer to the one end of the sheet bundle than the position where the forward carriage is started, and is configured to be carried outside of another end of the sheet bundle.

9. An image forming system including a sheet processing apparatus, wherein the sheet processing apparatus comprises:

a pressing unit configured to provide additional folding to a fold line portion of a sheet bundle by pressing the fold line portion;

a carriage unit configured to reciprocate the pressing unit in width directions of the sheet bundle;

a guiding shaft configured to support the pressing unit and configured to guide movement of the pressing unit; and a supporting unit configured to support the pressing unit and configured to move on a structure provided to the sheet processing apparatus, the pressing unit including a first pressing portion and a second pressing portion that faces the first pressing portion, the first pressing portion including a pressing member configured to press the first pressing portion toward the second pressing portion, and the second pressing portion including the supporting unit.

10. The image forming system of claim 9, wherein the guiding shaft includes:

a first guiding shaft configured to guide the first pressing portion; and a second guiding shaft configured to guide the second pressing portion.

11. The image forming system of claim 9, wherein the supporting unit includes a rotating member configured to roll on a predetermined portion of the structure.

12. The image forming system of claim 9, wherein the supporting unit is provided in plurality.

13. The image forming system of claim 11, wherein the pressing unit includes a driving unit configured to drive the rotating member to move the supporting unit.

14. The image forming system of claim 9, wherein the supporting unit includes a sliding member configured to slide on a portion of the structure.

15. The image forming system of claim 9, wherein the supporting unit is positioned on an upstream side of the guiding shaft in a conveying direction of the sheet bundle.

16. The image forming system of claim 9, wherein during a forward carriage, the pressing unit is configured to start pressing from a position in a width direction of the sheet bundle, is carried outside of one end of the sheet bundle, and is configured to stop pressing, and during a reverse carriage, the pressing unit is configured to start pressing at a position nearer to the one end of the sheet bundle than the position where the forward carriage is started, and is configured to be carried outside of another end of the sheet bundle.

* * * * *